US011263987B2

(12) United States Patent
Ge et al.

(10) Patent No.: US 11,263,987 B2
(45) Date of Patent: Mar. 1, 2022

(54) METHOD OF ENHANCING CONTRAST AND A DUAL-CELL DISPLAY APPARATUS

(71) Applicant: HISENSE VISUAL TECHNOLOGY CO., LTD., Shandong (CN)

(72) Inventors: Zhongfeng Ge, Shandong (CN); Guang Tian, Shandong (CN)

(73) Assignee: HISENSE VISUAL TECHNOLOGY CO., LTD., Qingdao (CN)

( * ) Notice: Subject to any disclaimer, the term of this patent is extended or adjusted under 35 U.S.C. 154(b) by 50 days.

(21) Appl. No.: 16/847,942

(22) Filed: Apr. 14, 2020

(65) Prior Publication Data

US 2020/0320941 A1 Oct. 8, 2020

Related U.S. Application Data

(63) Continuation of application No. PCT/CN2020/081251, filed on Mar. 25, 2020.

(30) Foreign Application Priority Data

Apr. 4, 2019 (CN) ..... 201910272176.5

(51) Int. Cl.
*G09G 3/36* (2006.01)
*G09G 5/10* (2006.01)

(52) U.S. Cl.
CPC ..... *G09G 3/3607* (2013.01); *G09G 5/10* (2013.01); *G09G 2320/0646* (2013.01); *G09G 2360/141* (2013.01); *G09G 2360/145* (2013.01)

(58) Field of Classification Search
CPC ..... G09G 3/3607; G09G 5/10; G09G 2320/0646; G09G 2360/141;
(Continued)

(56) References Cited

U.S. PATENT DOCUMENTS 10,783,836 B2 * 9/2020 Zhang ..... G09G 3/3426
2005/0162362 A1 7/2005 Takasugi et al.
(Continued)

FOREIGN PATENT DOCUMENTS

CN 103502881 A 1/2014
CN 105047145 A 11/2015
(Continued)

OTHER PUBLICATIONS

International Search Report with English translation regarding International Appl. No. PCT/CN2020/081251 dated Jun. 30, 2020, 9 pages.
(Continued)

*Primary Examiner* — Antonio Xavier
(74) *Attorney, Agent, or Firm* — Crowell & Moring LLP

(57) ABSTRACT

The present disclosure describes methods of contrast enhancement and dual-cell display apparatus. The method includes receiving an RGB value of each second pixel of a displayed image, and determining a brightness value of each first pixel according to the RGB value of each second pixel. The method also includes determining a local brightness adjustment factor and a global brightness adjustment factor by performing statistics processing for local region brightness values and global image brightness values according to the brightness value of each first pixel; and calculating a brightness drive signal corresponding to the first pixel, according to the brightness value of each first pixel, the local brightness adjustment factor and the global brightness adjustment factor. The brightness drive signal adjusts a transmittance of a corresponding pixel of the first panel. The global brightness adjustment factor adjusts an output brightness value of a corresponding pixel of the first panel.

18 Claims, 18 Drawing Sheets

(58) Field of Classification Search
CPC ..... G09G 2360/145; G09G 2320/0626; G02F 1/133528; G02F 1/133602
See application file for complete search history.

(56) References Cited

U.S. PATENT DOCUMENTS

| | | | | |
|---|---|---|---|---|
| 2016/0063688 | A1* | 3/2016 | Yang | G09G 3/3426 345/589 |
| 2016/0170702 | A1* | 6/2016 | Jiang | G02F 1/133528 345/618 |
| 2017/0092228 | A1* | 3/2017 | Cote | G09G 3/3225 |
| 2018/0286326 | A1 | 10/2018 | Endo et al. | |
| 2021/0027728 | A1* | 1/2021 | Kimura | G09G 3/3607 |
| 2021/0035511 | A1* | 2/2021 | Kimura | G02F 1/1347 |

FOREIGN PATENT DOCUMENTS

| | | | |
|---|---|---|---|
| CN | 107342058 | A | 11/2017 |
| CN | 107450203 | A | 12/2017 |
| CN | 107644409 | A | 1/2018 |
| CN | 107730475 | A | 2/2018 |
| CN | 108020956 | A | 5/2018 |
| CN | 108831357 | A | 11/2018 |
| JP | H02198489 | A | 8/1990 |
| JP | H02309315 | A | 12/1990 |
| JP | H08220514 | A | 8/1996 |

OTHER PUBLICATIONS

Chinese Office Action with English translation regarding Appl. No. 201910272176.4 dated Mar. 15, 2021, 12 pages.

* cited by examiner

| | |
|---|---|
| Lmax2=255 | X-axis Lavg2 range0-255; |
| Lmax2=229 | X-axis Lavg2 range0-229; |
| Lmax2=204 | X-axis Lavg2 range0-204; |
| Lmax2=178 | X-axis Lavg2 range0-178; |
| Lmax2=153 | X-axis Lavg2 range0-153; |
| Lmax2=127 | X-axis Lavg2 range0-127; |
| Lmax2=102 | X-axis Lavg2 range0-102; |
| Lmax2=76 | X-axis Lavg2 range0-76; |
| Lmax2=51 | X-axis Lavg2 range0-51; |
| Lmax2=25 | X-axis Lavg2 range0-25; |
| Lmax2=1 | X-axis Lavg2 range0-1; |

METHOD OF ENHANCING CONTRAST AND A DUAL-CELL DISPLAY APPARATUS

This application is a continuation of International Application PCT/CN2020/081251 filed on Mar. 25, 2020, which claims the benefit of Chinese Patent Application No. 201910272176.5, filed with the Chinese Patent Office on Apr. 4, 2019, all of which are hereby incorporated by reference in their entireties.

FIELD

The present disclosure relates to display technology, and in particular to a method of enhancing contrast and a dual-cell display apparatus.

BACKGROUND

Liquid Crystal Display (LCD) panel itself does not have luminous characteristics, thus a light emitting source is needed to added behind the LCD panel. The LCD panel is provided with the background light by the light emitting source, and thus can display the image. FIG. 1 is a schematic structural diagram of a display apparatus, where the display apparatus includes a light emitting source 1 and a LCD panel 2, and the LCD panel 2 is provided with background light by the light emitting source 1, so that the LCD panel 2 can display the image.

When a panel's brightness is adjusted, an RGB coordinate system is generally converted into any one of a YCbCr coordinate system, a YUV coordinate system, an HSV coordinate system or an HIS coordinate system, and brightness and chromaticity are enhanced respectively to achieve adjustments of an overall contrast. Generally, the background light of different brightness is applicable to different local areas of a displayed image. For example, FIG. 2 is a schematic diagram of a displayed image, where the local area of a first displayed image is a low brightness image, suitable for a low brightness background light, and the local area of a second displayed image is a high brightness image, suitable for a high brightness background light. When processing a color signal with a method of enhancing contrast, the luminance difference between frames is not considered usually. Obviously, adjusting the displayed contrast through the LCD panel by using a single light emitting source cannot meet the above requirements.

SUMMARY

In view of the above technical problems, the present disclosure aims to provide a method of enhancing contrast and a dual-cell display apparatus.

The first aspect of present application provides a method of enhancing contrast for a dual-cell display apparatus. The method includes receiving, by a dual-cell display apparatus, an RGB value of each second pixel of a displayed image. The dual-cell display apparatus includes a memory storing instructions and a processor in communication with the memory. The method also includes determining, by the dual-cell display apparatus, a brightness value of each first pixel according to the RGB value of each second pixel. The second pixel is a pixel on a second panel of the dual-cell display apparatus, the first pixel is a pixel on a first panel of the dual-cell display apparatus, and the first panel is arranged between a light emitting source and the second panel. The method also includes determining, by the dual-cell display apparatus, a local brightness adjustment factor and a global brightness adjustment factor by performing statistics processing for local region brightness values and global image brightness values according to the brightness value of each first pixel. The method further includes calculating, by the dual-cell display apparatus, a brightness drive signal corresponding to the first pixel, according to the brightness value of each first pixel, the local brightness adjustment factor and the global brightness adjustment factor, wherein the brightness drive signal is configured to adjust a transmittance of a corresponding pixel of the first panel, and the global brightness adjustment factor is configured to adjust an output brightness value of a corresponding pixel of the first panel.

In some embodiments, the calculating the brightness drive signal corresponding to the first pixel, according to the brightness value of each first pixel, the local brightness adjustment factor and the global brightness adjustment factor includes: generating a local brightness adjustment value by performing stretch adjustment for the brightness value of the first pixel according to the local brightness adjustment factor; generating a global brightness adjustment value by performing stretch adjustment for the brightness value of the first pixel according to the global brightness adjustment factor; and calculating the brightness drive signal corresponding to the first pixel according to the local brightness adjustment value and the global brightness adjustment value.

In some embodiments, the global brightness adjustment factor includes a global brightness up-adjustment factor and a global brightness down-adjustment factor; where the generating the global brightness adjustment value by performing stretch adjustment for the brightness value of the first pixel according to the global brightness adjustment factor includes: calculating an average brightness value of the displayed image according to the brightness value of each first pixel; for one of a plurality of first pixels, in response to the brightness value of the first pixel being less than the average brightness value of the displayed image, generating a global brightness adjustment value by adjusting down the brightness value of the first pixel according to the global brightness down-adjustment factor; and in response to the brightness value of the first pixel being greater than the average brightness value of the displayed image, generating a global brightness adjustment value by adjusting up the brightness value of the first pixel according to the global brightness up-adjustment factor.

In some embodiments, the local brightness adjustment factor includes a local brightness up-adjustment factor and a local brightness down-adjustment factor; where the generating the local brightness adjustment value by performing stretch adjustment for the brightness value of the first pixel according to the local brightness adjustment factor includes: for any one of first pixels, constituting a local region of m*n pixel block where the first pixel is a center pixel, where brightness values of the local region includes brightness values of the m*n pixels; calculating an average brightness value of the local region according to the brightness values of the local region; generating a local brightness adjustment value by adjusting down the brightness value of the first pixel according to the local brightness down-adjustment factor, in response to the brightness value of the first pixel being less than the average brightness value of the local region; and generating a local brightness adjustment value by adjusting up the brightness value of the first pixel according to the local brightness up-adjustment factor, in response to the brightness value of the first pixel being greater than the average brightness value of the local region.

In some embodiments, the calculating the brightness drive signal corresponding to the first pixel according to the local brightness adjustment value and the global brightness adjustment value includes: calculating a local brightness weight coefficient according to the local region brightness value corresponding to the first pixel; calculating a local brightness output value according to the local brightness adjustment value and the local brightness weight coefficient; calculating a global brightness output value according to the global brightness adjustment value and a global brightness weight coefficient; where a sum of the local brightness weight coefficient and the global brightness weight coefficient is 1; and calculating the brightness drive signal corresponding to the first pixel according to the local brightness output value and the global brightness output value.

In some embodiments, the calculating the local brightness weight coefficient includes: selecting N local model regions, where a local model region includes: a model brightness value of a first model pixel, brightness values of neighbor pixels of the first model pixel, and a local model brightness weight coefficient corresponding to the first model pixel; calculating a model brightness complexity of the first model pixel according to the model brightness value and the brightness values of the neighbor pixels; constructing a first local brightness weight coefficient curve according to the model brightness complexity and the local model brightness weight coefficient; for one of a plurality of first pixels, calculating a complexity of the first pixel according to the local region brightness value corresponding to the first pixel, calculating the local brightness weight coefficient corresponding to the first model pixel according to the complexity of the first pixel and the first local brightness weight coefficient curve.

In some embodiments, the calculating the local brightness weight coefficient includes: selecting N local model regions, where a local model region includes: brightness values of the local model region, a local model brightness weight coefficient corresponding to a second model pixel; where the brightness values of the local model region includes: a model brightness value of the second model pixel and brightness values of neighbor pixels of the second model pixel; generating a first model frequency set by counting appearance frequencies of each brightness value in local model region; generating a second model frequency set by searching through the first model frequency set and deleting a portion of first model frequency smaller than a preset frequency; counting a model number of brightness values contained in the second model frequency set, and constructing a second local brightness weight coefficient curve according to the model number of brightness values contained in the second model frequency and the local model brightness weight coefficient; for one of a plurality of first pixel, counting a number of brightness values with a frequency greater than the preset frequency in the brightness values of the local region corresponding to the first pixel; and calculating the local brightness weight coefficient corresponding to the first pixel according to the number and the second local brightness weight coefficient curve.

In some embodiments, the calculating the local brightness weight coefficient includes: selecting N local model regions, where a local model region includes: a model brightness value of a third model pixel, brightness values of neighbor pixels of the third model pixel and a local model brightness weight coefficient corresponding to the third model pixel; calculating a model brightness characteristic of the third model pixel according to the model brightness value of the third model pixel and the brightness values of the neighbor pixels; constructing a third local brightness weight coefficient curve according to the model brightness characteristic and the local model brightness weight coefficient; for one of a plurality of first pixels, calculating a brightness characteristic of the first pixel; and calculating the local brightness weight coefficient corresponding to the first pixel according to the brightness characteristic of the first pixel and the third local brightness weight coefficient curve.

In some embodiments, the method further including: determining a local color adjustment factor by counting RGB values of a local region according to RGB values of a plurality of second pixels; determining a global color adjustment factor according to RGB values of the second pixels on the entire second panel, and statistic values for global image brightness values of the second panel; and calculating a color drive signal corresponding to the second pixel according to the RGB value of the second pixel, the local color adjustment factor and the global color adjustment factor, where the color drive signal is configured to adjust the RGB value of the second pixel corresponding to the second panel.

The second aspect of the present disclosure provides a dual-cell display apparatus, including: a memory storing instructions; a processor in communication with the memory; a first panel in connection with the processor and configured to receive a brightness drive signal and adjust a transmittance corresponding to a first pixel according to the brightness drive signal; and a second panel in connection with the processor and configured to receive a color drive signal and adjust an RGB value corresponding to a second pixel according to the color drive signal. When the processor executes the instructions, the processor is configured to: receive an RGB value of each second pixel of a displayed image; determine a brightness value of each first pixel according to the RGB value of each second pixel, where the second pixel is a pixel on a second panel of the dual-cell display apparatus, the first pixel is a pixel on a first panel of the dual-cell display apparatus, and the first panel is arranged between a light emitting source and the second panel; determine a local brightness adjustment factor and a global brightness adjustment factor by performing statistics processing for local region brightness values and global image brightness values according to the brightness value of each first pixel; and calculate a brightness drive signal corresponding to the first pixel, according to the brightness value of each first pixel, the local brightness adjustment factor and the global brightness adjustment factor; where the brightness drive signal is configured to adjust a transmittance of a corresponding pixel of the first panel, and the global brightness adjustment factor is configured to adjust an output brightness value of a corresponding pixel of the first panel.

BRIEF DESCRIPTION OF THE DRAWINGS

To describe embodiments of the present disclosure or the related art more clearly, drawings required in the embodiment of the present disclosure will be briefly introduced below. It is apparent that the drawings described below are merely some embodiments of the present disclosure and other drawings may also be obtained by those of ordinary skill in the art based on these drawings without paying creative work.

DETAILED DESCRIPTION

The embodiments of the present disclosure will be described clearly and fully below in combination with accompanying drawings in the embodiments of the present disclosure. It is apparent that the described embodiments are merely part of embodiments of the present disclosure rather than all embodiments. Other embodiments achieved by those of ordinary skill in the art based on the embodiments in the present disclosure without paying creative work shall all fall within the scope of protection of the present disclosure.

In the descriptions of the present disclosure, it is to be understood that an orientation or position relationship indicated by terms such as "center", "upper", "lower", "front", "back", "left", "right", "vertical", "horizontal", "top", "bottom", "inside" and "outside" is an orientation or position relationship shown based on the accompanying drawings, and is only used to facilitate describing the present disclosure and simplify the description rather than indicate or imply that a described apparatus or element should have a particular orientation or be constructed and operated in the particular orientation, and thus shall not be construed as limiting to the present disclosure.

In the descriptions of the present disclosure, it is to be noted that terms "install", "connection" and "connect" are to be broadly understood, unless otherwise clearly specified and defined. For example, the connection may be a contact connection, or a detachable connection, or an integrated connection. Persons of ordinary skill in the art may understand specific meanings of the above terms in the present disclosure according to a specific situation.

In the embodiments of present disclosure, vertex buffer objects (VBO) is a memory buffer created in the memory space of video card, which is used to store all kinds of attribute information of vertex, such as vertex coordinates, vertex normal vectors and vertex color data, etc.

Random access memory (RAM), also called main memory, is an internal memory that directly exchanges data with central processing unit (CPU). The RAM can be read and written at any time at a very quick speed. The RAM is usually used as a temporary data storage medium for operating system or other running programs.

Serial peripheral interface is abbreviated to SPI.

Figure 1:
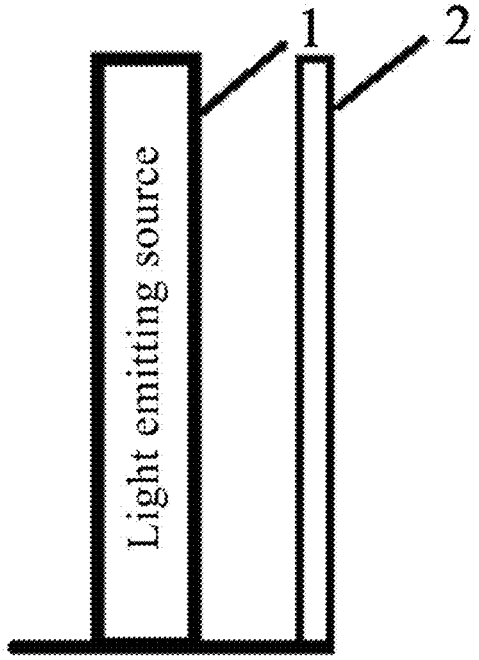
FIG. 1 is a structural schematic diagram illustrating a display apparatus.
Figure 2:
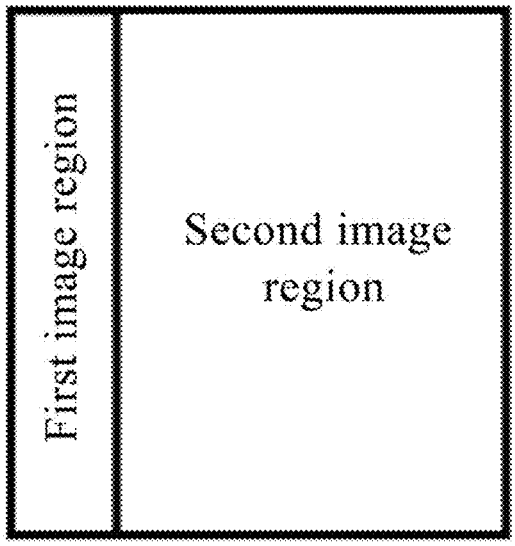
FIG. 2 is a schematic diagram illustrating image brightness area division of one frame displayed image.
Figure 3:
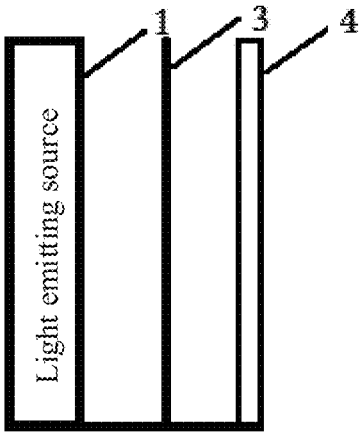
FIG. 3 is a structural schematic diagram illustrating a dual-cell display apparatus according to an embodiment of the present disclosure.

In the case that a single LCD panel cannot achieve high contrast brightness adjustment, a dual-cell structure is used. The upper panel is responsible for color signal processing, and the lower panel is responsible for enhancing high contrast. A structure of a dual-cell display apparatus is shown in FIG. 3, including a light emitting source 1, a first panel 3 and a second panel 4; where the first panel 3 is located between the light emitting source 1 and the second panel 4. Alternatively, the second panel 4 is used for RGB detail processing and image compensation, and the first panel 3 is used for enhancing contrast through the transmittance of pixels in different partitions. Transmittance of each transmission region of the first panel 3 can be adjusted, so the light emitted by the light emitting source 1 will display different brightness after passing through different regions of the first panel 3, thus obtaining the effect that the background light intensity in different regions of a displayed image is inconsistent.

Figure 4:
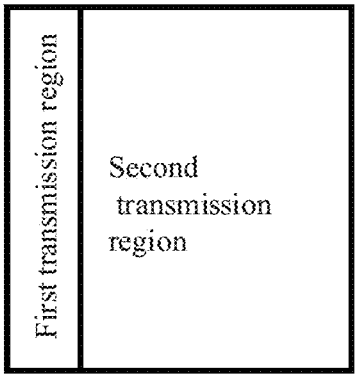
FIG. 4 is a schematic diagram illustrating different transmission regions of a first panel of a dual-cell display apparatus according to an embodiment of the present disclosure.

For example, when the left half of a frame image is a dark scene, and the right half of the image is a bright scene, in order to present high contrast, the brightness of the region corresponding to the image of the left half of the second panel is supposed to be reduced, and the brightness of the region corresponding to the image of the right half of the second panel is supposed to be increased. FIG. 4 is a schematic diagram illustrating different transmission regions of the first panel, where a first transmission region and a second transmission region of the first panel 3 correspond to a dark scene area and a bright scene area of the image respectively. Transmittance of the first transmission region is 20%, and transmittance of the second transmission region is 80%. The light emitting from the light emitting source 1 provides background light for the second panel 4 after passing through the first panel 3. At this time, the background light of a region in the second panel 4 corresponding to the first transmission region is darker and the background light of a region in the second panel 4 corresponding to the second transmission region is brighter.

Figure 5:
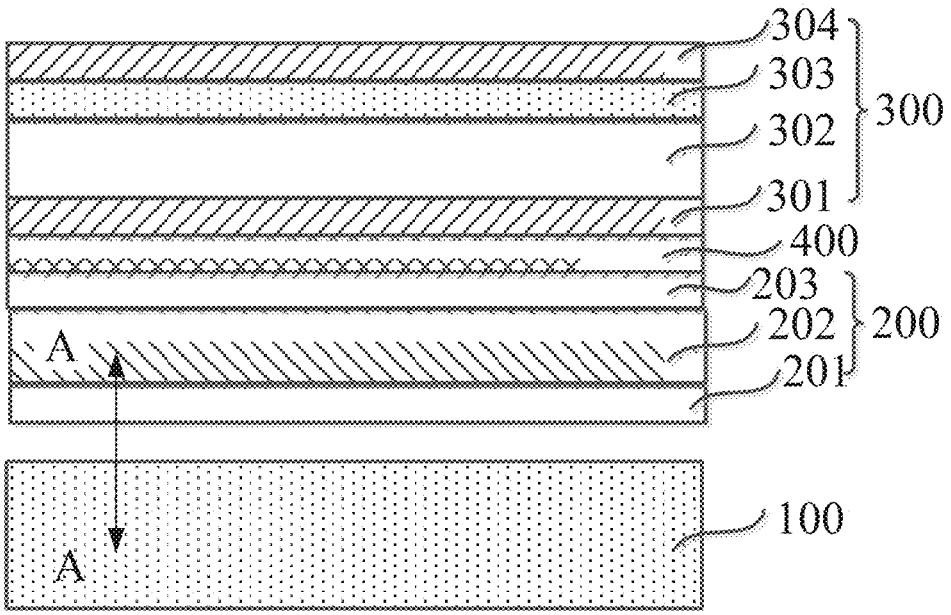
FIG. 5 is a schematic diagram illustrating an exploded structure of a dual-cell display apparatus according to an embodiment of the present disclosure.
Figure 6:
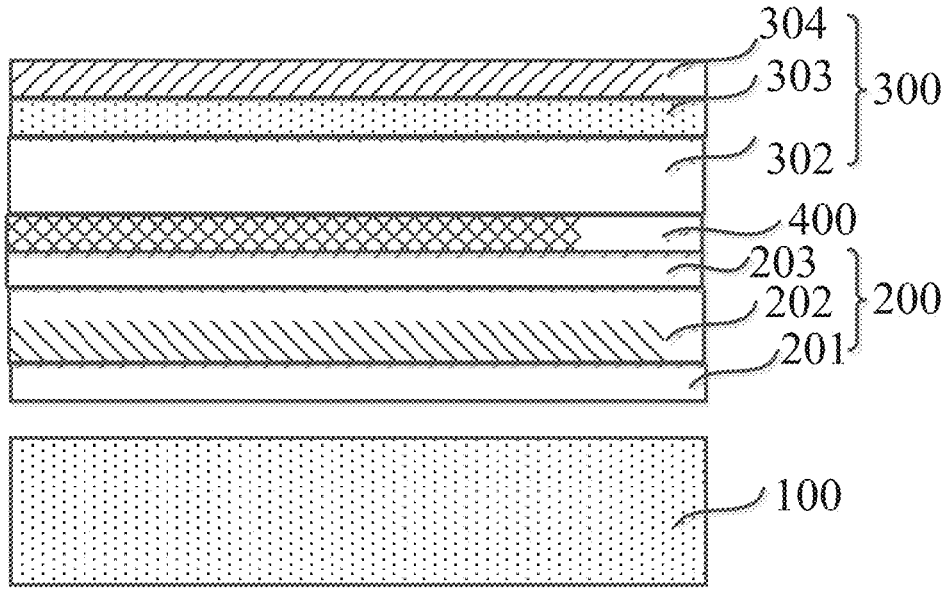
FIG. 6 is a schematic diagram illustrating an exploded structure of a dual-cell display apparatus according to another embodiment of the present disclosure.
Figure 7:
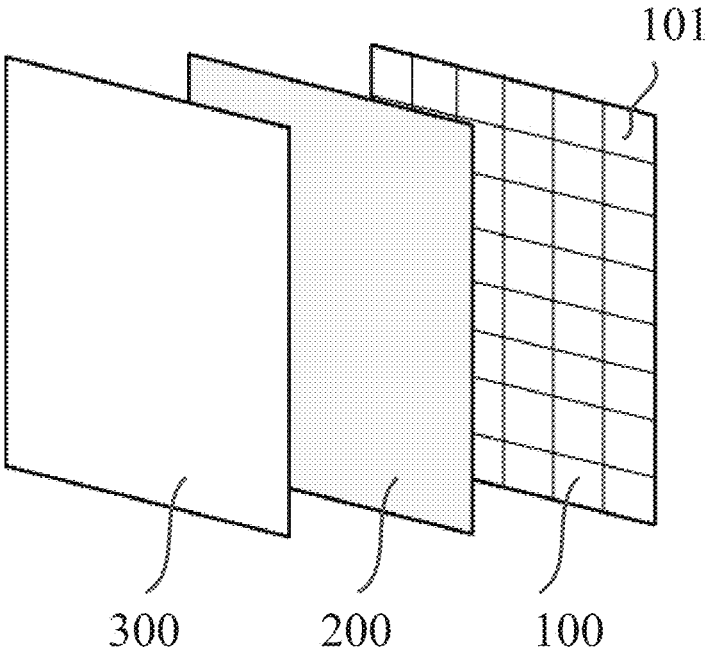
FIG. 7 is a block diagram illustrating a principle of a dual-cell display apparatus according to an embodiment of the present disclosure.

Alternatively, the dual-cell display apparatus includes a backlight module 100, a first panel 200, a second panel 300 and an adhesive layer 400 which are all stacked in order. FIG. 5 or FIG. 6 is a structural schematic diagram illustrating an exploded structure of a dual-cell display apparatus according to an embodiment of the present disclosure. FIG. 7 is a block diagram illustrating a principle of a dual-cell display apparatus according to an embodiment of the present disclosure.

As shown in FIG. 5, FIG. 6 and FIG. 7, the backlight module 100 is used to provide a light source for transmitting, the first panel 200 is a light control panel for controlling a light flux for the light from the backlight module 100 into the second panel 300, the second panel 300 is a color panel for displaying an image, and the adhesive layer 400 is used to fix the first panel 200 and the second panel 300 together into an integral unit.

Along an A-A direction of the dual-cell display apparatus, the first panel 200 includes a first polarizer 201 adjacent to the backlight module 100, a first liquid crystal light valve layer 202 and a second polarizer 203 in order. Polarization direction (or the transmittance axis) of the first polarizer 201 and polarization direction of the second polarizer 203 are perpendicular to each other. The light from the backlight module 100 is converted into a first polarized light after passing through the first polarizer 201. Then, the first polarized light enters the first liquid crystal light valve layer 202. In this case, according to the contents of the displayed image, the direction of the first polarized light is rotated by controlling liquid crystal in the first liquid crystal light valve layer 202 to rotate through voltage. Then, the first polarized light with a rotated angle enters the second polarizer 203 and converts into second polarized light. Since the polarization direction of the first polarizer 201 and the polarization direction of the second polarizer 203 are perpendicular to each other, the control of the light flux entering the second panel 300 is realized. It is noted that the first panel 200 does not include a light filter, If the light from the backlight module 100 is white light, the first panel 200 is a monochromatic panel.

Along the A-A direction of the dual-cell display apparatus, the second panel 300 includes a third polarizer 301 adjacent to the first panel 200, a second liquid crystal light valve layer 302, a filter 303 and a fourth polarizer 304 in order. Polarization direction of the third polarizer 301 and polarization direction of the fourth polarizer 304 are perpendicular to each other. The polarization direction of the second polarizer 203 and the polarization direction of the third polarizer 301 are parallel to each other. When the second polarized light from the first panel 200 enters the third polarizer 301, the second polarized light does not convert in polarization direction and then enters the second liquid crystal light valve layer 302. According to the contents of the displayed image, the polarization direction of the second polarized light is rotated by controlling liquid crystal in the second liquid crystal light valve layer 302 to rotate through voltage. The second polarized light with a rotated angle enters the filter 303 and changes into colored light. Then, the colored light enters the fourth polarizer 304 and is converted into third polarized light. Since the polarization direction of the third polarizer 301 and the polarization direction of the fourth polarizer 304 are perpendicular to each other, the control of the light flux of the colored light is realized, thereby realizing color display of an image.

When external water vapor enters between the first panel 200 and the second panel 300, the water vapor will solidify into water drops due to temperature changes between the first panel 200 and the second panel 300, thereby affecting the display effect. The adhesive layer 400 bonds the first panel 200 and the second panel 300 together in a surface attaching manner. The surface attaching refers to full attaching, that is, an adhesive layer is coated on the whole surface. To avoid affecting light transmission, the adhesive layer 400 may be a transparent adhesive layer, such as an optically clear adhesive (OCA) or an optical clear resin (OCR). To ensure a bonding effect and avoid making the dual-cell thicker, the thickness of the adhesive layer is between 0.15 mm and 0.75 mm, preferably, between 0.25 mm and 0.5 mm.

It is noted that the first panel 200 includes a polarizer, for example, the second polarizer 203, and the second panel 300 includes a polarizer, for example, the third polarizer 301. FIG. 5 illustrates a case where the first panel 200 and the second panel 300 each have two polarizers. In another embodiment of the present disclosure, the first panel 200 and the second panel 300 share a polarizer. FIG. 6 illustrates a case that the first panel 200 and the second panel 300 share one polarizer. In a case that a display requirement is satisfied, saving one polarizer may reduce costs of the display apparatus. As shown in FIG. 6, a difference from FIG. 5, is that the dual-cell display apparatus does not include the third polarizer 301. In the display apparatus, the polarization direction of the first polarizer 201 and the polarization direction of the second polarizer 203 are perpendicular to each other, and the polarization direction of the second polarizer 203 and the polarization direction of the fourth polarizer 304 are perpendicular to each other. Similar to a principle of an optical path of the dual-cell display apparatus shown in FIG. 5, the second polarized light from the first panel 200 directly enters the second liquid crystal light valve layer 302. According to the contents of the displayed image, the polarization direction of the second polarized light is rotated by controlling liquid crystal in the second liquid crystal light valve layer 302 to rotate through voltage. The second polarized light with a rotated angle enters the filter 303 and changes into colored light. Then, the colored light enters the fourth polarizer 304 and is converted into the third polarized light. Since the polarization direction of the second polarizer 203 and the polarization direction of the fourth polarizer 304 are perpendicular to each other, the control of the light flux of the colored light is realized, thereby realizing the color display of an image. In the dual-cell display apparatus shown in FIG. 6, the adhesive layer 400 is not limited to arranging between the second polarizer 203 and the second liquid crystal light valve layer 302, which may also locate between the first liquid crystal light valve layer 202 and the second polarizer 203.

The first liquid crystal light valve layer 202 and the second liquid crystal light valve layer 302 are similar in structure and include an upper substrate, a lower substrate and a liquid crystal box located between the upper substrate and the lower substrate.

The liquid crystal light valve layers in the first panel 200 and the second panel 300 both include a plurality of liquid crystal boxes. Similar to a principle of light control in the second panel 300 (the color panel), the first panel 200 takes a single pixel as an independent light valve to realize pixel-level light control. Compared with a display apparatus with only one panel, the dual-cell display apparatus has two layers of pixel-level light control, thereby realizing a finer control. Since the first panel 200 realizes the pixel-level light control, compared with the single-cell display apparatus, a brightness of a dark frame is significantly reduced through cooperation of the first panel 200 and the second panel 300, so that a problem that the dark frame has a certain brightness due to no absolute non-transmission of the liquid crystal light valve layer in the single-cell display apparatus is solved, thereby significantly increasing a static contrast of a liquid crystal display apparatus.

Since the first panel 200 realizes light control through the polarizer and the rotation of liquid crystal and the transmittance of the polarizer is 38%-48%, the entire transmittance of the display apparatus will be reduced. In the present disclosure, a resolution of the first panel 200 to be smaller than a resolution of the second panel 300, that is, the number of pixels in the first panel 200 is set to be smaller than the number of pixels in the second panel 300, to avoid an insufficient display brightness of the display apparatus, resulting from a reduced transmittance of the light from the backlight module through the first panel due to using the dual-cell. A ratio of the number of pixels in the second panel 300 and the number of pixels in the first panel 200 is not less than 4:1, such as 4:1 or 16:1. That is, when the resolution of the second panel 300 is 8K, the resolution of the first panel 200 is 4K or 2K; when the resolution of the second panel 300 is 4K, the resolution of the first panel 200 is 2K.

Specifically, in some embodiments of the present disclosure, the resolution of the first panel 200 is 1920*1080, and the resolution of the second panel 300 is 3840*2160.

In some embodiments of the present disclosure, as shown in FIG. 7, to further increase the image contrast, the backlight module 100 adopts multiple backlight partitions to control. That is, a backlight source in the backlight module 100 is divided into a plurality of backlight partitions 101, and the brightness of each backlight partition 101 is dynamically changed according to brightness information contained in the displayed image information. A bright area in the image corresponds to a high backlight brightness, and a dark scene area in the image corresponds to a low backlight brightness. Compared with constant backlight provided by the backlight module, problems that a pure black frame still has weak light leakage and power consumption is large are solved by dynamically adjusting the backlight brightness, thereby further increasing a brightness contrast of the image shown in the dual-cell display apparatus and improving the image quality.

In the dual-cell display apparatus, the problem that black frames shown in the dual-cell display apparatus are not black enough is further solved by combining dual panels and the control of the backlight partitions, thereby a display contrast of the image is better improved.

Next, the controls of the dual-cell display apparatus for the dual panels and the multi-backlight-partition will be discussed below.

Figure 8:
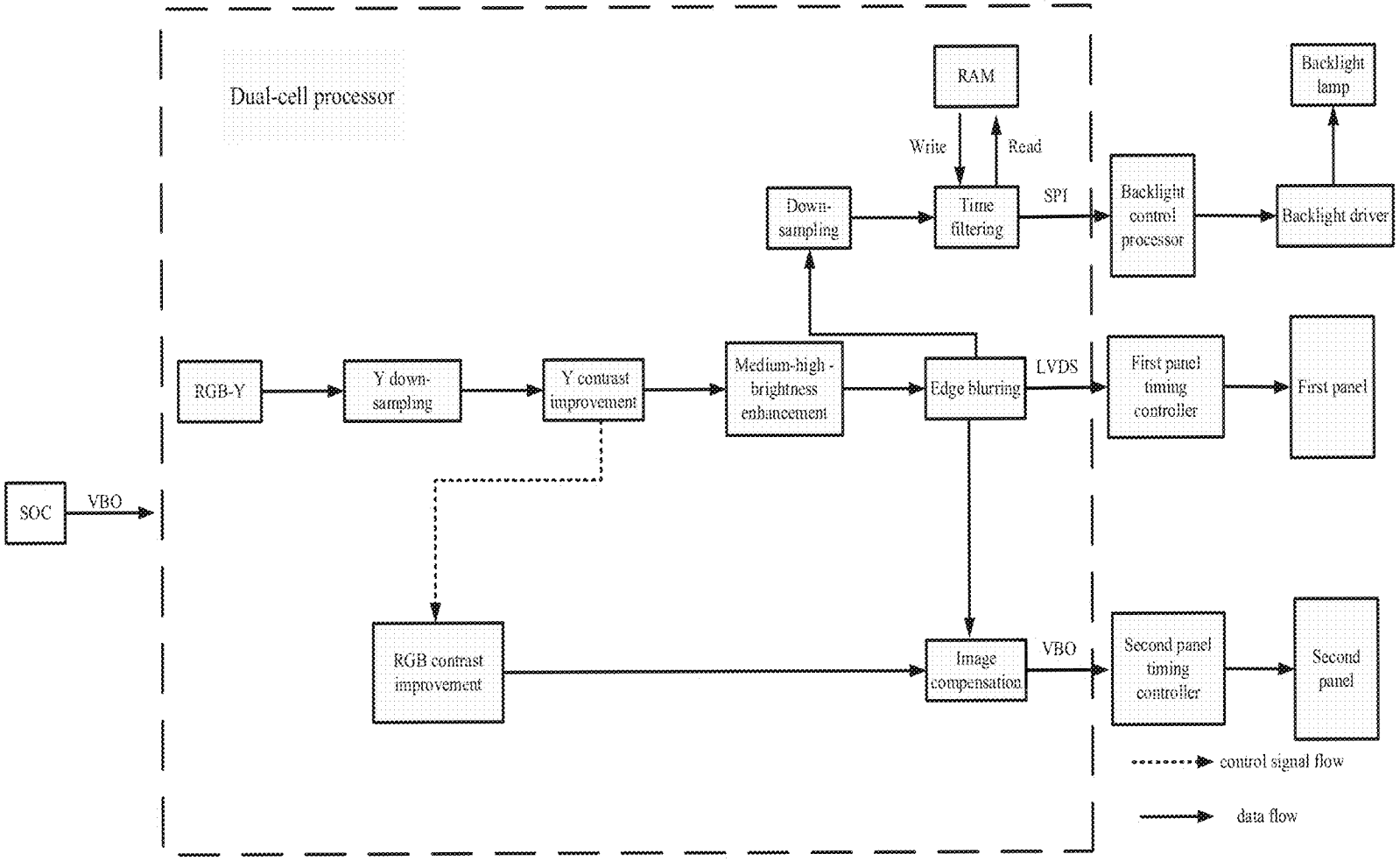
FIG. 8 is a block diagram illustrating a principle of a control system of a dual-cell display apparatus according to an embodiment of the present disclosure.

FIG. 8 is a block diagram illustrating a principle of a control system in a dual-cell display apparatus. As shown in FIG. 8, the dual-cell display apparatus includes a system on chip (SOC), a dual-cell processor, a first panel, a first panel timing controller (TCON), a second panel, a second panel timing controller (TCON), a backlight control microcontroller unit (MCU), a backlight driver and a backlight lamp.

The SOC outputs an image signal, and the dual-cell processor receives the image signal. The dual-cell processor is configured to generate dimming data for the first panel in response to the image signal, where the dimming data is sent to the first panel timing controller, and the first panel timing controller performs drive control for the first panel according to the dimming data. The dual-cell processor is further configured to generate image data for the second panel in response to the image signal, where the image data is sent to the second panel timing controller, and the second panel timing controller performs display control for the second panel according to the image data. The dual-cell processor is further configured to generate backlight data for backlight control in response to the image signal, where the backlight data is sent to the backlight control MCU, the backlight control MCU generates dimming information, such as a duty ratio and an electric current, and then sends the dimming information to the backlight driver, and the backlight driver realizes drive control for the backlight lamp according to the dimming information, such as the duty ratio and the electric current.

Descriptions will be made below with the resolution of the first panel being 1920*1080(2K) and the resolution of the second panel being 3840*2160(4K).

A process of generating dimming data is described below. After receiving a 4K image data signal from the SOC, the dual-cell processor firstly converts an RGB value of a pixel in the image into a first brightness value (Y) of the pixel, and then generates a second brightness value corresponding to the pixel of the first panel by performing down-sampling processing for Y. In this way, resolution reduction processing from 4K to 2K is realized. Then, enhancing Y contrast is performed according to the second brightness value, where the enhancing Y contrast includes enhancing brightness of a local region and an entire region. Specifically, a local brightness adjustment factor and a global brightness adjustment factor are determined by performing statistics processing for the brightness values of the local region and the brightness values of a global image according to the second brightness value, and the enhancing Y contrast is performed according to the second brightness value, the local brightness adjustment factor and the global brightness adjustment factor. Next, the overall brightness of a medium-high brightness area is increased by performing enhancement processing for the medium-high brightness area according to the image with different contrasts. Then, edge blurring processing is performed for the medium-high brightness area, so that the smooth transition is realized between regions with different brightness in a frame by performing edge blurring processing. In some examples of the present disclosure, smoothing may be performed by spatial filtering, so that a problem of unsmooth light waveforms resulting from the liquid crystal boxes split in the first panel and isolation columns between the liquid crystal boxes is solved. Finally, the dimming data generated through the above operations is transmitted to the first panel timing controller (TCON) through a Low Voltage Differential Signaling (LVDS) interface, and the first panel timing controller performs drive control for the first panel according to the dimming data.

A process of generating the image data signal is described below. After receiving a 4K image signal from the SOC, the dual-cell processor enhances RGB contrast for the pixel, uses a global image brightness statistical value for generating the dimming data, and enhances entire and local RGB contrast according to the global image RGB value and the local region RGB value, so that a black area on the display image is blacker, and a bright area is brighter, thereby increasing the entire contrast of the image. Further, to better maintain the brightness of a low-medium-brightness area when the brightness of the first panel is reduced, corresponding image compensation is performed for the displayed image according to brightness information of the first panel. In this way, the displayed image with the brightness lost when the displayed image passes through the first panel, is compensated on the second panel. The finally-generated image data is transmitted to the second panel timing controller (TCON) through a V-By-One (VBO) interface, and the second panel timing controller performs drive control for the second panel according to the dimming data.

In some embodiments of the present disclosure, the multiple partitions control technology and the dual-cell technology are combined. If the traditional backlight control is directly combined with a dual-cell platform, two modules are completely independent. At this time, the characteristics of the dual-cell platform (the first panel will reduce the backlight transmittance) is not considered in the backlight control, therefore, the backlight control is easy to be dark. Further, more backlight partitions will cause more serious dark tendency. Therefore, a process of generating the backlight data in the present disclosure is described below.

A down-sampling module is added after the spatial filtering of the first panel. The down-sampling module directly down-samples the original 1920*1080 to a target backlight partition number, and then, performs time filtering. That is, blended data is obtained by blending the backlight value of a current frame with the backlight value of a previous frame. Then, the blended data is written into a RAM, and then read out from the RAM to finally obtain the backlight data. The obtained backlight data is transmitted to the backlight control MCU through a SPI. The backlight control MCU generates dimming information, such as a duty ratio and an electric current, and then sends the dimming information, such as the duty ratio and the electric current to the backlight driver, and the backlight driver regulates the drive control of the backlight lamp according to the dimming information, such as the duty ratio and the electric current.

The combination of the multiple backlight partitions technology and the dual-cell technology is realized according to the above manner, and a local backlight lamp is made as bright as possible by multiplexing data, so as to enable the dual-cell display apparatus to transmit more brightness and saving hardware resources.

Figure 9:
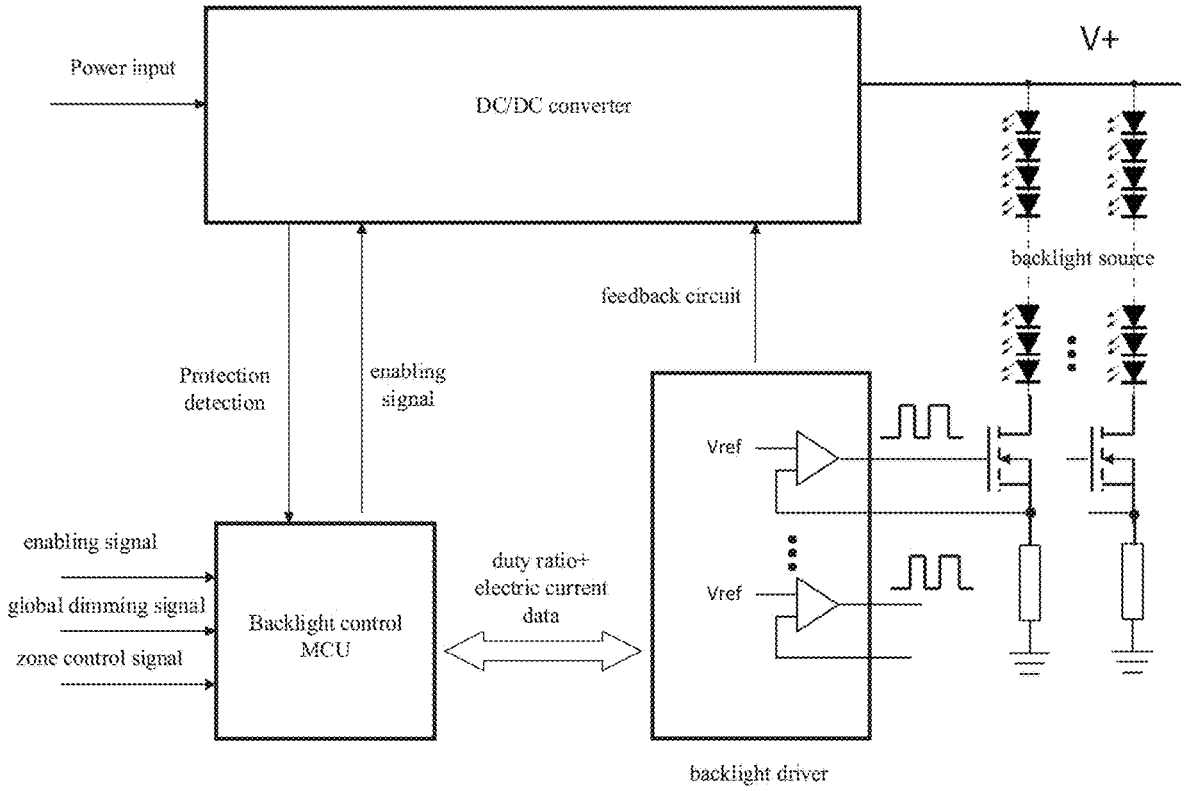
FIG. 9 is a block diagram illustrating a principle of a multi-path backlight drive in multi-partition backlight control according to an embodiment of the present disclosure.

FIG. 9 is a block diagram illustrating a principle of multiple backlight drive in a multiple partitions backlight control according to some examples of the present disclosure. As shown in FIG. 9, the backlight control MCU is configured to process the brightness information of each backlight partition, search a mapping table pre-stored in a partition mapping unit of the backlight control MCU, and adjust the duty ratio of each partition according to an obtained coordinate position of the partition at the same time. The duty ratio of the partition is adjusted as follows: the backlight control MCU sends backlight duty ratio data of each backlight partition to the backlight driver, specifically, a pulse-width modulation (PWM) driver, and a PWM driver generates a corresponding PWM control signal to drive a backlight source (a LED strip). If necessary, the backlight processing unit sends electric current data to the PWM driver which then adjusts the electric current according to the electric current data and a preset reference voltage $V_{ref}$. Generally, the PWM driver is formed by cascading a plurality of chips, and each chip further drives the multiplex PWM driver output current to LED strip.

Further, in the dual-cell display apparatus, the first panel reduces the backlight transmittance, therefore the backlight control is easy to be dark, which is disadvantageous for brightness in a bright frame. Therefore, in some examples of the present disclosure, on the basis of performing backlight partitions control, the bright area in the image is highlighted by dynamically increasing the backlight peaking brightness of the bright frame and a conventional display frame based on the LED backlight peaking enhancement technology, thereby further increasing the image contrast and an image layering sense.

Figure 10:
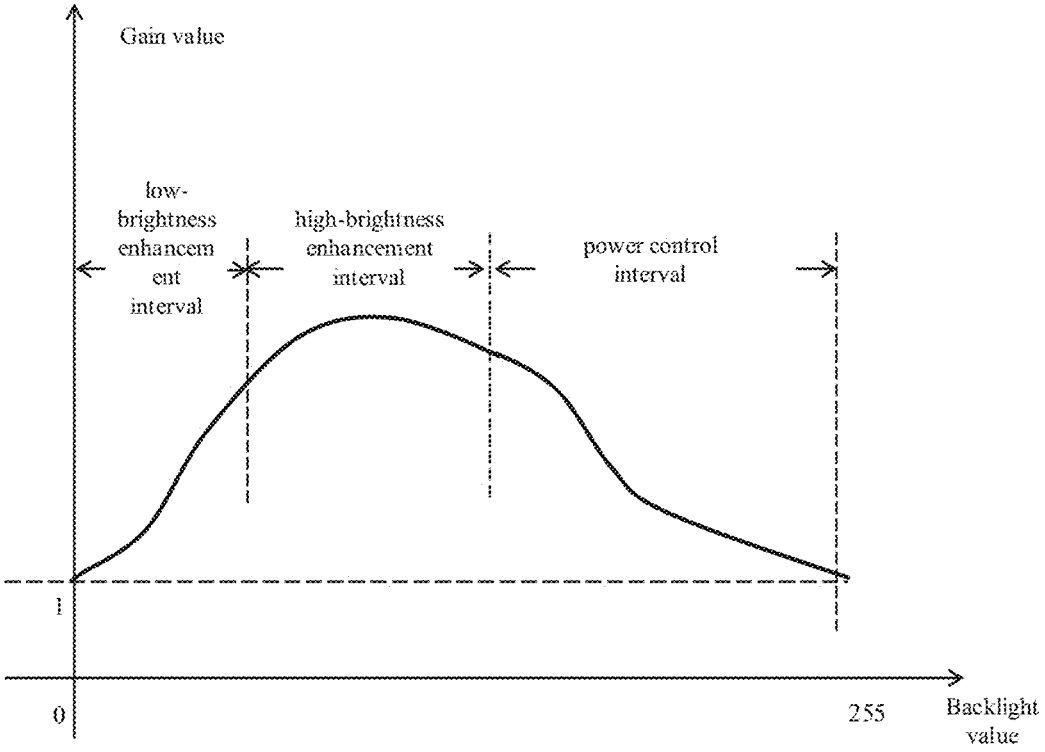
FIG. 10 is a schematic diagram illustrating a gain adjustment curve of backlight values according to an embodiment of the present disclosure.

FIG. 10 is a schematic diagram illustrating a gain adjustment region of a backlight value according to an embodiment of the present disclosure. As shown in FIG. 10, an abscissa is a backlight value in a value range of [0, 255], and an ordinate is a gain value in a value range of [1,+∞). However, during an actual implementation, the value range of the gain value is set to [1,2] according to an actual power setting requirement; further, the gain value is not limited to an integer, and thus may also be a non-integer. The gain adjustment curve is divided into a low-brightness enhancement interval, a high-brightness enhancement interval and a power control interval. When an average value of the backlight values in the backlight region is low, a corresponding gain value is in the low-brightness enhancement interval. Along with a change of a displayed content in the backlight region, when an average value of the backlight values in the backlight region is in a high-brightness enhancement interval, the corresponding gain value is in the high-brightness enhancement interval, and the high-brightness area in the image is well highlighted. When an average value of the backlight values in the backlight region is high, because the brightness of the entire image in the backlight region is sufficiently high, it is not necessary to enhance the backlight again. On the contrary, because of power consumption, it is necessary to decrease the backlight gain effect. Since the determined average values of the backlight values in different backlight regions are different, a determined gain value is different as well, so that the brightness contrast of the image is large and graduation of the image becomes obvious in the display process.

Figure 11:
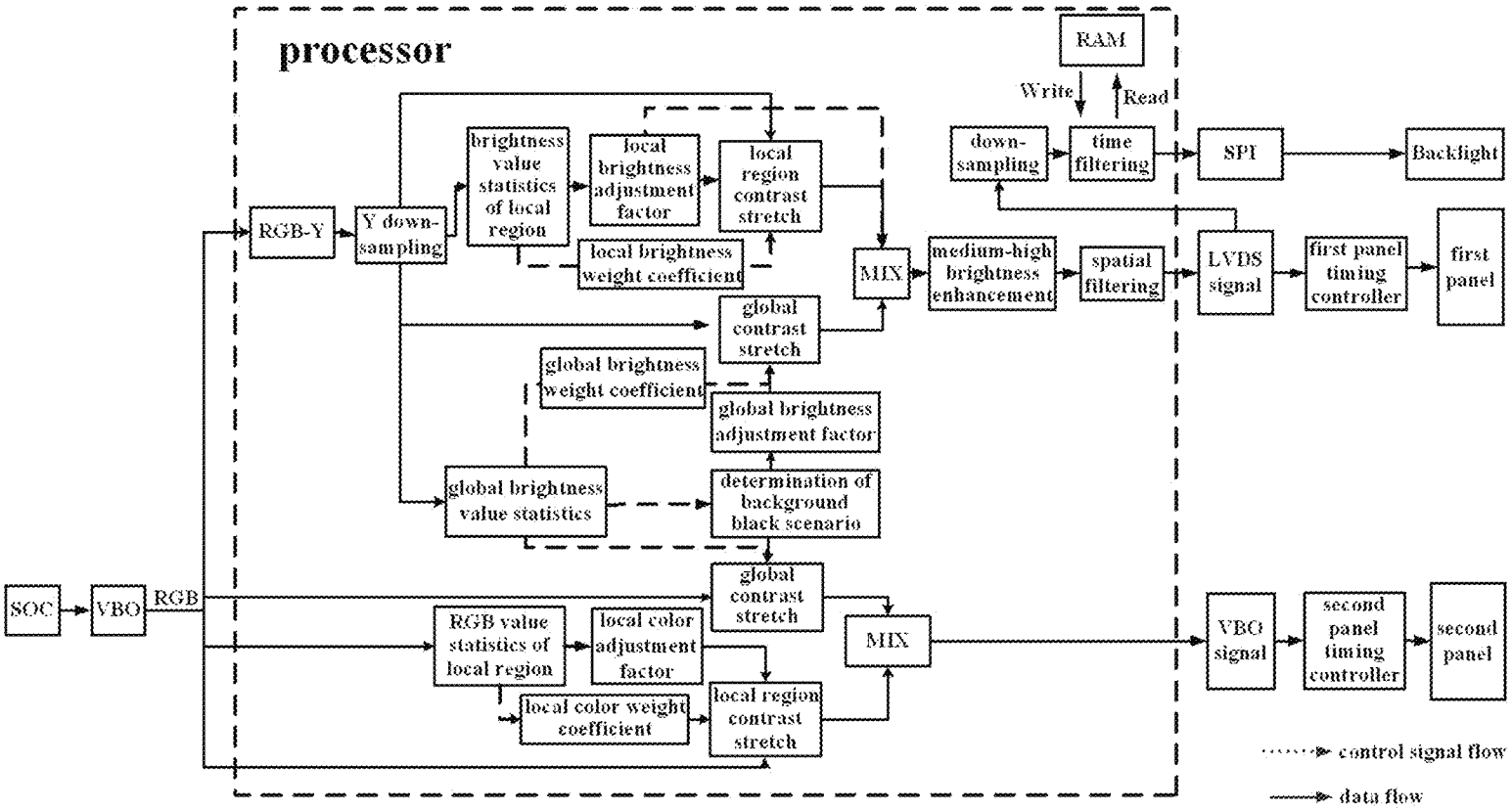
FIG. 11 is a block diagram illustrating a detailed principle of a control system of a dual-cell display apparatus according to an embodiment of the present disclosure.

Specifically, the embodiment of this disclosure provides a dual-cell display apparatus. As shown in FIG. 11, the apparatus includes:

A processor, a first panel connected with the processor, and a second panel connected with the processor.

After the processor receives an RGB value of each second pixel transmitted through the VBO, the processor converts the RGB value of each second pixel into a brightness value (Y) of each second pixel, and then generates a brightness value of each first pixel by performing down-sampling processing for Y. On one hand, the processor determines a local brightness adjustment factor and a local brightness weight coefficient by performing statistics processing for local region brightness values according to the brightness value of each first pixel; and the processor determines a local brightness output value by stretching local contrast of the brightness value of each first pixel according to the local brightness adjustment factor and the local brightness weight coefficient. On the other hand, the processor determines a global brightness adjustment factor and a global brightness weight coefficient by performing statistics processing for global image brightness values according to the brightness value of each first pixel; and the processor determines a global brightness output value by stretching global contrast for the brightness value of each first pixel according to the global brightness adjustment factor and the global brightness weight coefficient. Then the processor generates a brightness drive signal by mixing the global brightness output value and the local brightness output value, and the brightness drive signal is transmitted to the first panel through the LVDS.

In another implementation mode of this disclosure, After the processor receives an RGB value of each second pixel transmitted through the VBO, the processor determines a local color adjustment factor and a local color weight coefficient by performing statistics processing for local region RGB values according to the RGB value of each second pixel. The local color adjustment factor and the local color weight coefficient are used to generate a local color output value by stretching local contrast for the RGB value of each second pixel. Global statistics results of the brightness value of each first pixel and global RGB values statistics results of each second pixel are used to generate a global color output value by stretching the global contrast for the RGB value of each second pixel. Then the processor generates a color drive signal by mixing the global color output value and the local color output value, and the color drive signal is transmitted to the first panel through the VBO.

Alternatively, the brightness drive signal transmitted through the LVDS is down-sampled and filtered, and then transmitted to the light emitting source (i.e., backlight source) through the SPI, which is used to adjust the bright of background light from the light emitting source.

Figure 12:
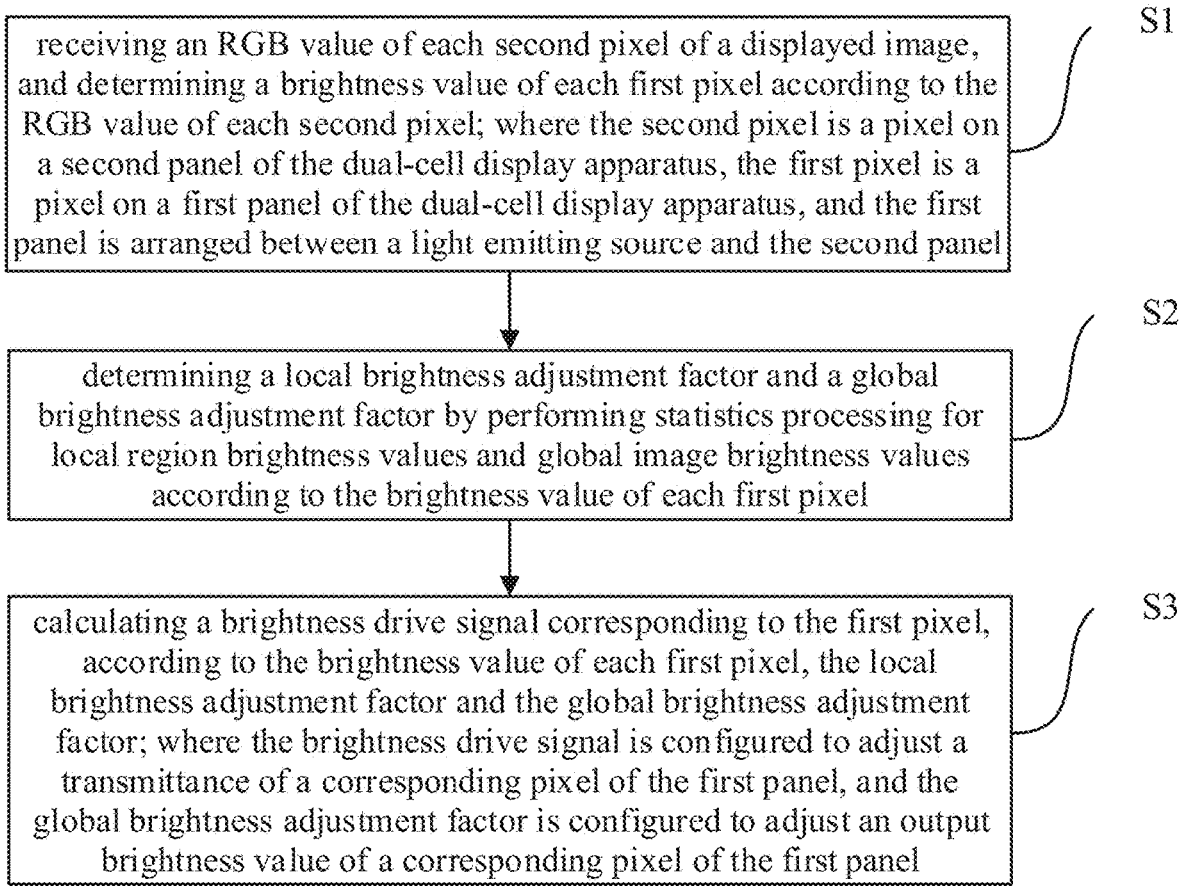
FIG. 12 is a schematic diagram illustrating a method of enhancing contrast according to an embodiment of the present disclosure.

Specifically, the processor is configured to perform the following steps S1-S3, as shown in FIG. 12.

At step S1, receiving an RGB value of each second pixel of a displayed image, and determining a brightness value of each first pixel according to the RGB value of each second pixel; where the second pixel is a pixel on a second panel of the dual-cell display apparatus, the first pixel is a pixel on a first panel of the dual-cell display apparatus, and the first panel is arranged between a light emitting source and the second panel.

At step S11, a RGB value of each second pixel is converted to a brightness value of each second pixel.

An RGB color space used mostly in a computer corresponds to red, green and blue respectively, and different colors are formed by adjusting ratios of three-color components. Generally, these three colors are stored by using 1, 2, 4, 5, 16, 24 and 32 bits. In some embodiments of the present disclosure, the RGB component is represented by 8 bits, that is, the maximum value is 255.

Generally, a RGB value is converted into a Y value (brightness value) based on the following equation.

$$Y=0.299R+0.587G+0.114B \quad (1)$$

In the process of actual implementation, in some scenarios, the Y value calculated by the above method is not reasonable. For example, when the displayed image is a pure blue frame, the RGB value is (0,0,255), and the Y value obtained through the above equation is 29. In this case, the brightness value of transmitted light will be much reduced compared with the RGB value (0,0,255) in the pure blue frame.

Therefore, to enhance the contrast, a maximum value of the R, G and B values is selected as the Y value. In this way, the Y value using a maximum value of the R, G and B values is much increased compared with the Y value calculated by using the conversion equation in the pure blue frame (0,0, 255). When the RGB value is only converted into the Y value, the use of the maximum value of the RGB values is reasonable. At this time, the brightness value Y is calculated based on the following equation.

$$Y=\mathrm{MAX}(R,G,B) \quad (2)$$

At step S12, the brightness value of each second pixel is down-sampled to the brightness value of each first pixel.

The RGB value of each second pixel of the displayed image is converted into the brightness value of the second pixel by the above method, and then, a corresponding brightness value of the first pixel is generated by down-sampling the brightness value of the second pixel.

In some embodiments of the present disclosure, for example, the second panel has pixels of 4 k, that is, the second panel has the second pixels of 3840*2160. The first panel has the first pixels of 1920*1080. Correspondingly, pixels of 2 k is obtained by down-sampling pixels of 4 k, that is, small regions of 1920*1080 are generated. The first pixels are in one-to-one correspondence with the small regions of the second panel. The brightness value of each first pixel is calculated in a manner as follows: 4K brightness values are scaled based on a principle that every four values are scaled to one value. Like general scaling, a set containing brightness values of the first pixels of 1920*1080 is finally generated by using a maximum brightness value of four pixels, an average brightness value of four pixels, a minimum brightness value of four pixels and a median brightness value of four pixels.

At step S2, determining a local brightness adjustment factor and a global brightness adjustment factor by performing statistics processing for local region brightness values and global image brightness values according to the brightness value of each first pixel.

At step S21, The global brightness adjustment factor includes: a global brightness down-adjustment factor global_min_y and a global brightness up-adjustment factor global_max_y.

A process of calculating global_min_y includes: determining the maximum brightness value P_frame_max, the average brightness value P_frame_avg and the minimum brightness value P_frame_min of the displayed image by traversing the brightness value set of the first pixels.

Specifically, the maximum brightness value P_frame_max, the minimum brightness value P_frame_min and the average brightness value P_frame_avg of the image are directly obtained by traversing the brightness value set of the first pixels, where the maximum brightness value and the minimum brightness value are not actual values but obtained according to the statistics processing. Whether the number of pixels of grayscale 0 sum=gray[0] is greater than the number of pixels of a preset grayscale is determined from low 0-grayscale (that is, a brightness value that is equal to 0 in the image). If not, accumulation is performed from the number of pixels of grayscale 0 to the number of pixels of grayscale 1, that is, sum_num=gray[0]+gray[1], until the condition is satisfied. At this time, the grayscale value is P_frame_min. Similarly, whether the number of pixels of grayscale 255 sum=gray[255] is greater than the number of pixels of the preset grayscale is determined from the grayscale 255. If not, accumulation is performed from the number of pixels of grayscale 255 to the number of pixels of grayscale 254, that is, sum_num=gray[255]+gray[254], until the condition is satisfied. At this time, the grayscale value is P_frame_max. For example, the number of pixels of the minimum grayscale value is preset to 8. When there is only one pixel of grayscale 0, the number of pixels of grayscale 1 is 4; when the number of pixels of grayscale 2 is more than 3, the minimum brightness value P_frame_min is set to a grayscale value 2. Therefore, interference and jump are avoided.

Where global_min_y=f(P_frame_min), global_min_y is a function relating to P_frame_min, and global_max_y=f (P_frame_max), global_max_y is a function relating to P_frame_max. A hardware implementation method may be a look up table (LUT) method.

At step S211, alternatively, the global brightness adjustment factor is calculated by determining a black area of an image background, where determining the black area of the image background includes:

initializing back_black_nearr_flag=0; and calculating sum_gray_cont.

Specifically, a process of calculating sum_gray_cont includes: finding the black area of the image background after performing histogram statistics processing for the image, where the number sta-gray[k] of pixels distributed between the brightness values Gray_TH0 and Gray_TH1 is large and greater than NUM_TH0 (a preset value), and the number of brightness values between Gray_TH0 and Gray_TH1 is small, which is generally not greater than a threshold number TH0; counting the number cont satisfying the condition that sta-gray[k] is greater than or equal to NUM_TH0 by counting sta-gray[k] between Gray_TH0 and Gray_TH1 according to the distribution of brightness values; and counting an accumulation value sum_gray_cont of sta-gray[k] under the condition that cont is less than or equal to TH0.

For example, it is assumed that Gray_TH0=12, Gray_TH1=20 and NUM_TH0=3000. Thus, the number sta-gray[k] of pixels corresponding to the brightness values of 12, 13, 14, 15, 16, 17, 18, 19 and 20 is counted. As a result, the brightness values with sta-gray[k] being greater than or equal to 3000 are counted as the brightness value 13 and the brightness value 14. Therefore, sum_gray_cont=sta-gray[13]+sta-gray[14].

If the sum_gray_cont is greater than or equal to sum_TH (a preset value), this frame image is determined as an image with the background being the black area, and back_black_near_flag is set to 1 at this time.

global_min_y is calculated by using two different f(P_frame_min) according to whether back_black_near_flag is 1;

if (back_black_near_flag=1), global_min_y1=f1 (P_frame_min);

if (back_black_near_flag=0), global_min_y2=f2 (P_frame_min), where global_min_y1> global_min_y2, and f1 and f2 are function curves.

The process of calculating global_min_y is global_min_y=f(P_frame_min), which is linearly adjusted. For example, f(P_frame_min)=(255−P_frame_min). Similarly, a process of calculating global_max_y is global_max_y=f(p_frame_max), which is linearly adjusted. For example, f(P_frame_max)=(255−P_frame_max).

Other non-linear adjustments may also be adopted. Considering hardware implementation, division is processed by the LUT method, thereby converting division into multiplication.

At step S22, the local brightness adjustment factor includes: a local brightness down-adjustment factor local_min_y and a local brightness up-adjustment factor local_max_y.

A m*n pixel block is selected by taking any first pixel as a center pixel of the m*n block. The brightness values of the m*n pixel block constitute a local region brightness value set.

Figure 13:
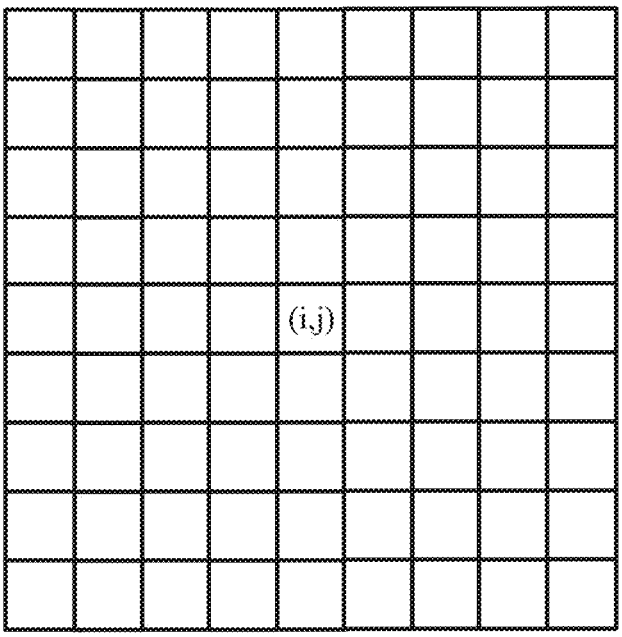
FIG. 13 is a schematic diagram illustrating 9×9 neighboring domains according to an embodiment of the present disclosure.

Each first pixel corresponds to a coordinate value (i, j). As shown in FIG. 13, with the position of the first pixel as the center of the m*n pixel block, the m*n pixel block may be a 9*9 block. The brightness values of the m*n block constitute a local region brightness value set.

The maximum brightness value P_local_max(i, j), the average brightness value P_local_avg(i, j) and the minimum brightness value P_local_min(i, j) of the local region are determined by traversing local region brightness value set.

Generally, the minimum brightness value and the maximum brightness value of the local region are obtained by searching through data of all position points, and the average brightness value of the local region is obtained by accumulating the brightness values of all first pixels of the local region as a sum and dividing the sum by the total number of first pixels of the local region.

A process of calculating local_min_y(i, j) is similar to the process of calculating global_min_y, which will not be described in detail herein.

Where a process of calculating local_max_y(i, j) is similar to the process of calculating global_max_y, which will not be described in detail herein.

At step S3, calculating a brightness drive signal corresponding to the first pixel, according to the brightness value of each first pixel, the local brightness adjustment factor and the global brightness adjustment factor; where the brightness drive signal is configured to adjust a transmittance of a corresponding pixel of the first panel, and the global brightness adjustment factor is configured to adjust an output brightness value of a corresponding pixel of the first panel.

At step S31, a global brightness adjustment value is calculated.

For a brightness value P(i, j) of any first pixel, if P(i, j)<P_frame_avg, the global brightness adjustment value is:

$$P_out_global(i,j)=(P_Frame_avg-(P_frame_min-global_min_y))/(P_frame_avg-P_frame_min)*(P(i,j)-P_frame_avg)+P_frame_avg, \quad (3)$$

where P_out_global(i, j) is the global brightness adjustment value, and global_min_y is the global brightness down-adjustment factor.

For the brightness value P(i, j) of any first pixel, if P(i, j)=P_frame_avg, the global brightness adjustment value is:

$$P_out_global(i,j)=P_frame_avg. \quad (4)$$

For the brightness value P(i, j) of any first pixel, if P(i, j)> P_frame_avg, the global brightness adjustment value is:

$$P_out_global(i,j)=(P_frame_avg-(P_frame_max+global_max_y))/(P_frame_avg-P_frame_max)*(P(i,j)-P_frame_avg)+P_frame_avg, \quad (5)$$

where global_max_y is the global brightness up-adjustment factor.

Figure 14:
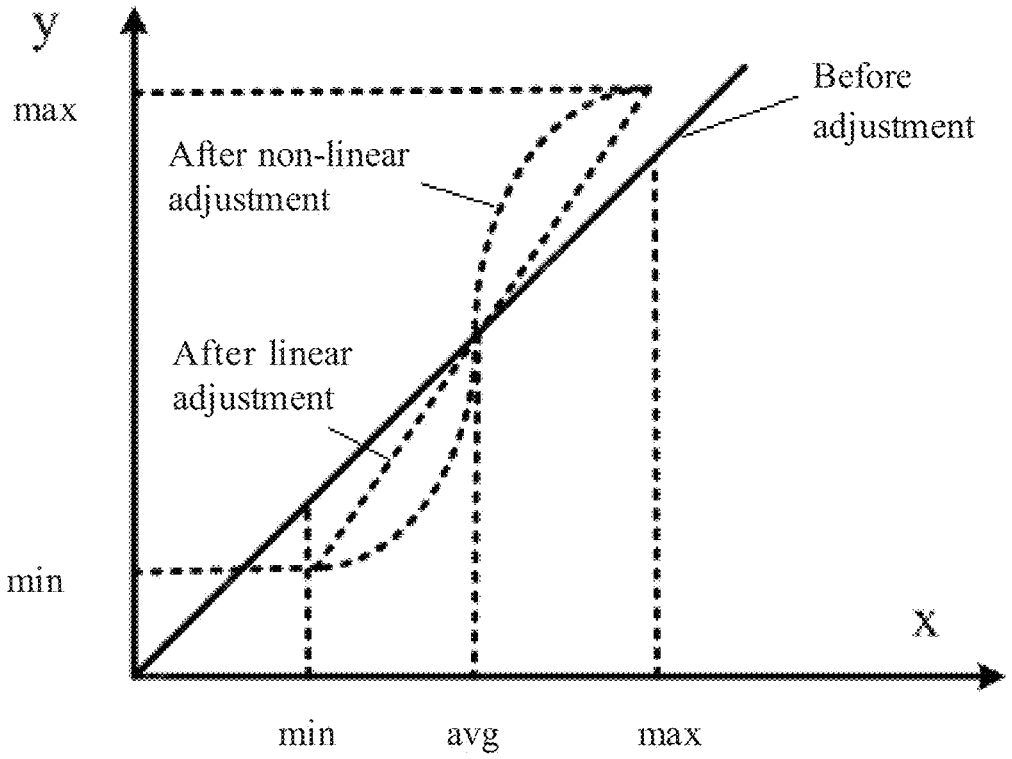
FIG. 14 is a schematic diagram illustrating a brightness value adjustment curve according to an embodiment of the present disclosure.

A specific adjustment result is as shown in FIG. 14, where x-axis is P(i, j), and y-axis is P_out_global (i, j).

At step S32, a local brightness adjustment value is calculated.

For the brightness value P(i, j) of any first pixel, if P(i, j) is less than P_local_avg(i, j), the local brightness adjustment value is:

$$P_out_local(i,j)=(P_local_avg(i,j)-(P_local_min(i,j)-local_min_y(i,j)))/(P_local_avg\ (i,j)-P_local_min(i,j))*(P(i,j)-P_local_avg(i,j))+local_avg\ (i,j), \quad (6)$$

where P_out_local(i, j) is a second brightness adjustment value, and local_min_y(i,j) is the local brightness down-adjustment factor.

If P(i, j) is equal to P_local_avg(i, j), the local brightness adjustment value is:

$$P_out_local(i,j)=P_local_avg(i,j). \quad (7)$$

If P(i, j) is greater than P_local_avg(i, j), the local brightness adjustment value is:

$$P_out_local(i,j)=(P_local_avg(i,j)-(P_local_max(i,j)+local_max_v(i,j)))/(P_local_avg(i,j)-P_local_max(i,j))*(P(i,j)-P_local_avg(i,j))+P_local_avg(i,j). \quad (8)$$

At step S33, the brightness drive signal is calculated as follows:

$$P_out(i,j)=weight_local(i,j)*P_out_local(i,j)+weight_global*P_out_global(i,j);\ weight_local(i,j)+weight_global=1; \quad (9)$$

or $$P_out(i,j)=weight_local*P_out_local(i,j)+weight_global(i,j)*P_out_global(i,j)+weight_org*P(i,j); \quad (10)$$

$$weight_local(i,j)+weight_global+weight_org(i,j)=1. \quad (11)$$

In the above equations, weight_org(i, j) is an adjustment coefficient, P_out(i, j) is the brightness drive signal, weight_local(i, j) is a local brightness weight coefficient, and weight_ global is a global brightness weight coefficient.

At step S331, a process of calculating the local brightness weight coefficient in the above equation is described below.

In some embodiments of present disclosure, N local model regions are selected on the first panel. The local model region includes: a model brightness value i of a first model pixel, brightness values of neighboring domains (m*n−1) of the first model pixel and a local model brightness weight coefficient weight_local(i, j)$_{model}$ corresponding to the first model pixel.

The local model region further includes a model brightness complexity, i.e., includes an average value $A_{model}$ of an appearance frequency $h_g(i)_{model}$ of the brightness value i, a power value $Power_{model}$ of the appearance frequency $h_g(i)_{model}$ of the brightness value i and an entropy value $Entropy_{model}$ of the appearance frequency $h_g(i)_{model}$ of the brightness value i of the local model region.

A specific calculation process includes: counting the appearance frequency $h_g(i)_{model}$ of the brightness value i of the local model region by using a histogram;

(a) Average value:

$$A_{model}=\frac{1}{M_{model}}\sum_i ih_g(i)_{model};$$

$M_{model}=m_{model}\times n_{model}$ (b) Power value: $Power_{model}=\Sigma_i[h_g(i)_{model}]^2$ (c) Entropy value: $Entropy_{model}=\Sigma_i h_g(i)_{model}\lg h_g(i)_{model}$.

Constructing a weight_local(i, j)$_{model}$=f($A_{model}$, $Power_{model}$, $Entropy_{model}$) curve as a first local brightness weight coefficient curve.

For any first pixel, the average value A(i, j), the power value Power(i, j) and the entropy value Entropy(i, j) of the appearance frequency $h_g(i)$ of the local region brightness value i corresponding to the first pixel are calculated according to the local region brightness value corresponding to the first pixel, and then, the local brightness weight coefficient weight_local(i, j) corresponding to the first pixel is calculated by placing A(i, j), Power(i, j) and Entropy(i, j) into the weight_local(i, j)$_{model}$=f($A_{model}$, $Power_{model}$, $Entropy_{model}$) curve.

In other embodiments of present disclosure, N local model regions are selected on the first panel, and the local model region includes: a brightness value of the local model region and a local model brightness weight coefficient corresponding to a second model pixel. The brightness value of the local model region includes: a model brightness value of the second model pixel and a brightness value of a block of the second model pixel.

A first model frequency set is generated by counting the appearance model frequency of the model brightness values of different second model pixels in different local model regions; a second model frequency set is generated by traversing the first model frequency set and deleting the model frequency smaller than a preset frequency; the model number of the model brightness values contained in the second model frequency set is counted, and the second local brightness weight coefficient curve is constructed according to the model number of each local model region and the local brightness weight coefficient.

For any first pixel, the number of brightness values with the frequency greater than the preset frequency in the local region brightness values corresponding to the first pixels is counted, and the local brightness weight coefficient corresponding to the first pixel is calculated according to the above number and the second local brightness weight coefficient curve.

Specifically, N local model regions are selected, and the first model frequency set is generated by calculating the appearance frequency $h_g(i)_{model}$ of each brightness value in each local model region respectively; the second model frequency set is generated by traversing the first model frequency set and deleting the frequency smaller than the preset frequency; the number $count_{model}$ of brightness values contained in the second model frequency set is counted; the $weight_local_{model}$=f($count_{model}$) curve, that is, the second local brightness weight coefficient curve, is constructed.

The appearance frequencies $h_g(i)$ of different brightness values is counted according to the local region brightness value set corresponding to any first pixel, and the second frequency set is generated by traversing the first frequency set and deleting the frequency smaller than the preset frequency, and then, the number count(i, j) of brightness values contained in the second frequency set is counted and then the local brightness weight coefficient weight_local(i, j) corresponding to the first pixel is calculated by placing the count(i, j) into the $weight_local_{model}$=f($count_{model}$) curve.

The number count of $h_g(i)$> NUM_th0 is counted. NUM_th0 is the preset frequency, and NUM_th0 is generally 3000, which can be configured (for example, when the resolution of the first panel is 1920×1080). For example, when the resolution of the first panel is, for example, 1920×1080, the range of count is from 0 to 1920×1080. The count is set to an independent variable of the abscissa, weight_local(i, j) is set to a dependent variable of the ordinate, and the numerical range of the local brightness weight coefficient weight_local(i, j) is [0, 1].

When the histogram statistics processing is performed for the local model region, the resource consumption is still relatively large. To further simplify the hardware implementation method, an embodiment of the present disclosure provides another method of calculating the local brightness weight coefficient weight_local(i, j).

Specifically, N local model regions are selected on the first panel. If the brightness value of any first pixel (i.e., the third model pixel) in the local model region is p(i, j)$_{model}$, the brightness values of two first pixels adjacent to the first pixel, i.e., a brightness value p(i±1, j)$_{model}$ of No. 1 first pixel and a brightness value p(i, j±1)$_{model}$ of No. 2 first pixel, are determined.

Calculations are performed according to the following equations.

$$p_diff0(i,j)_{model}=|local_pixel(i,j)_{model}-local_pixel(i,j\pm1_{model}| \quad (12)$$

$$p_diff1(i,j)_{model}=|local_pixel(i,j)_{model}-local_pixel(i\pm1,j)_{model}| \quad (13)$$

$$p_sum_diff(i,j)_{model}=\Sigma_{i=0}^{n-1}\Sigma_{j=0}^{m-1}(P_diff(i,i)_{model}+diff(i,j)_{model}) \quad (14)$$

$$p_arg_diff(i,j)_{model}=p_sum_diff(i,j)_{model}/(m\times n), \quad (15)$$

where p_diff0$(i, j)_{model}$ and p_diff1$(i, j)_{model}$ are a difference between the brightness value of the first pixel and the brightness value of the No. 2 first pixel and a difference between the brightness value of the first pixel and the brightness value of the No. 1 first pixel respectively. A model brightness characteristic p_sum_diff(i, j)$_{model}$ or p_avg_diff (i, j)$_{model}$ is obtained based on the above equation, where m*n refers to the number of pixels contained in the local region brightness value set.

A p_weight_local$_{model}$=f(p_sum_diff$_{model}$) curve or a p_weight_local$_{model}$=f(p_arg_diff$_{model}$) curve is constructed.

For the brightness value p(i, j) of any first pixel, p_sum_diff(i, j) corresponding to the p(i, j) is calculated, and the local brightness weight coefficient weight_local corresponding to the first pixel is calculated by placing the p_sum_diff (i, j) into the p_weight_local$_{mode}$=f(p_sum_diff$_{model}$) curve; or the p_arg_diff(i, j) corresponding to the p(i, j) is calculated, and then the local brightness weight coefficient weight_local corresponding to the first pixel is calculated by placing the p_arg_diff(i, j) into the p_weight_local$_{mode}$=f (p_avg_diff$_{model}$) curve.

Optionally, when local sampling is performed, if the central point is in upper several rows and left several columns or in lower several rows and right several columns of the image, the data taken by a template block goes beyond the range of the image, and a duplicating method is used for the template block.

For example, the template block is of a size of 9*9 and the central point is (0,0). The upper left corner is filled with the data of the point (0,0); the data in a row of the upper right corner and a column of the lower left corner is duplicated from the data in the first row and the first column of the template block respectively; the data of the lower right corner directly comes from data in the original image; a data padding format is in the form of symmetrical duplication. A column is taken as an example. The template block includes columns of −4, −3, −2, −1, 0, 1, 2, 3 and 4. the column −4 is duplicated from the data of the column 4 rather than the data of the column 1, the data of the column −3 is duplicated from the data of the column 3, the column −2 is duplicated from the data of the column 2, and the column −1 is duplicated from the data of the column 1. The data in the upper right corner is also duplicated from the data of (0,0).

Alternatively, the processor is further configured to: determine a local color adjustment factor by counting a local region RGB value according to the RGB value of each second pixel; determine a global color adjustment factor according to a global RGB value of the second panel, and by performing statistics processing for global image brightness values of the second panel; and calculate a color drive signal corresponding to the second pixel according to the RGB value of each second pixel, the local color adjustment factor and the global color adjustment factor; where the color drive signal is configured to adjust the RGB value of the second pixel corresponding to the second panel.

The first panel is used to receive the brightness drive signal and adjust a transmittance corresponding to the first pixel according to the brightness drive signal.

The second panel is used to receive the color drive signal and adjust the RGB value corresponding to the second pixel according to the color drive signal.

As can be seen from above disclosure, the embodiments provide a method of enhancing contrast and a dual-cell display apparatus. The present disclosure can be used in a ultra high definition television image quality processing chip or a TCON chip, and can also be used in a FPGA or a multi-core processor, so as to complete the brightness control of the dual-cell, achieve the effect of the background light control of multiple local areas and more accurate background light "partition control". In a case where light emitting source is constant, by controlling the transmittance of the first panel, a finer background light control and a more accurate partition control are realized, and a dynamic contrast of the image is further improved.

The processing of enhancing medium-high-brightness is described below.

Figure 15:
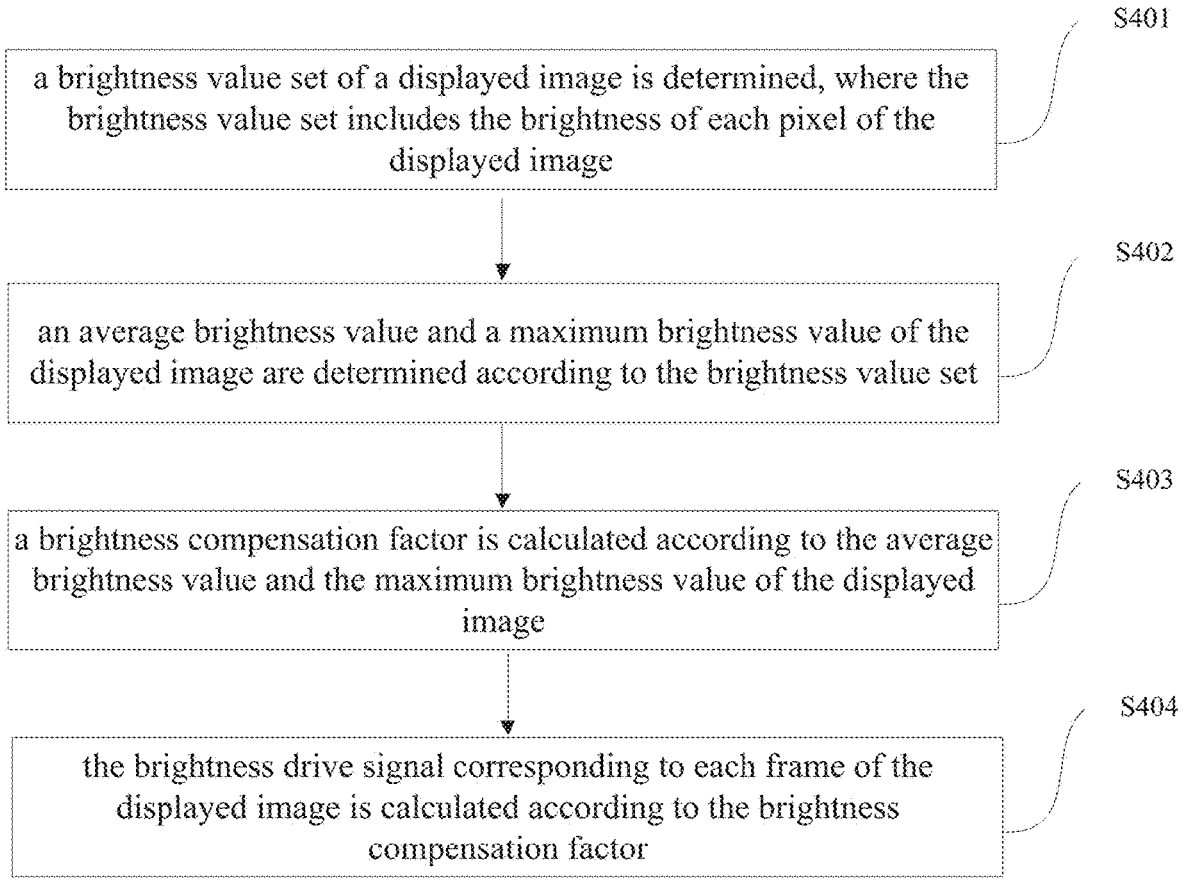
FIG. 15 is a flowchart illustrating a brightness driving method according to an embodiment of the present disclosure.

A data flow processed by enhancing Y contrast is received for subsequent processing. Specifically, as shown in FIG. 15, the embodiment of this disclosure provides a brightness driving method, the method includes the following steps S401-S404.

At step S401, a brightness value set of a displayed image is determined, where the brightness value set includes the brightness of each pixel of the displayed image.

An RGB color space used mostly in a computer corresponds to red, green and blue correspondingly, and different colors are formed by adjusting ratios of three-color components. Generally, these three colors are stored by using 1, 2, 4, 5, 16, 24 and 32 bits. In some embodiments of the present disclosure, the RGB component is represented by 8 bits, that is, the maximum value is 255.

In some embodiments of the present disclosure, firstly, the RGB value of each pixel is obtained, and then the RGB value is converted into the brightness value.

The RGB value is converted into the Y value (the brightness value) based on the following equation: Y=0.299R+0.587G+0.114B.

In the process of actual implementation, in some scenarios, the Y value calculated by the above method is not reasonable, so a maximum value of the R, G and B values is selected as the Y value. For example, when the displayed image is a pure blue frame, the Y value obtained through the above equation is 29. In this case, the brightness value of transmitted light will be much reduced compared with the RGB value (0,0,255) in the pure blue frame. When the RGB value is only converted into the Y value, the use of the maximum value of the RGB values is reasonable. At this time, the brightness value Y is calculated based on the following equation: Y=MAX(R, G, B)

Each pixel corresponds to a brightness of the pixel, and the brightness of a displayed image refers to a brightness set of pixels {Y1, Y2, Y3 . . . }.

At step S402, an average brightness value Lavg1 and a maximum brightness value Lmax1 of the displayed image are determined according to the brightness value set.

It is to be noted that the calculated maximum brightness value Lmax1 of the displayed image is not a maximum value of all brightness values but a maximum value in terms of statistics. Generally, after the statistics processing is completed, a grayscale of which the number of pixels is not zero is obtained from grayscale 255 to grayscale 0, and the number of pixels contained in each grayscale is required to exceed a particular threshold (for example, 0.1% of the total number). If the number of pixels of the grayscale does not satisfy the requirement, the number of pixels of the grayscale is accumulated to the number of pixels of the next grayscale, until the number of pixels of the grayscale satisfying the condition is obtained. The grayscale is the maximum brightness value of the displayed image. For the calculation of the average brightness value Lavg1 of the displayed image, if the brightness values of the pixels of one displayed image are all accumulated and then divided by the number of pixels, a data bit width of the accumulated sum will generally overflow. Particularly, when the data bit widths are 10 bits and 12 bits, for convenience of calculation, the average brightness value of each row is firstly calculated, and then the average brightness values of n rows are calculated, and then averaging is performed for average brightness values of the n rows and finally the average brightness value of the entire displayed image is obtained.

In the process of implementation, the display apparatus generally displays the displayed image based on a light blending principle. Therefore, each pixel is further divided into three sub-pixels, i.e., R, G and B. Three sub-pixels correspond to different brightness, and thus the brightness corresponding to different pixels are also different. In this embodiment, when histogram statistics processing is performed for the brightness, the brightness in each pixel is a maximum brightness value corresponding to original brightness of three sub-pixels in the pixel. During the statistics processing, only one sub-pixel with the maximum brightness value is counted, which leads to a less statistics amount and a less calculation amount than a calculation amount of all sub-pixels. In this case, the statistics processing and the calculation are simpler and faster. On the other hand, the pixel brightness corresponding to the sub-pixel with the largest original brightness in the R, G and B sub-pixels, is used as the statistic value, which retains original displayed image information of an input displayed image as much as possible, compared with use of the pixel brightness corresponding to the lowest or middle value of the original brightness of three sub-pixels. Thus, the information loss of the input displayed image is less and the display effect of the displayed image is better.

At step S403, a brightness compensation factor is calculated according to the average brightness value and the maximum brightness value of the displayed image.

Specifically, the brightness compensation factor is obtained by placing the average brightness value and the maximum brightness value of the displayed image into a brightness compensation factor model.

In some embodiments of the present disclosure, the brightness compensation factor model is pre-constructed. The brightness compensation factor model is constructed based on the maximum brightness value Lmax2 of the model image and the average brightness value Lavg2 of the model image. A process of constructing the brightness compensation factor model includes steps S4031-S4035.

At step S4031, n groups of model images are selected, where the Lamx2*s* of different groups of model images are same, and the Lmax2 is the maximum brightness value in the model image.

For example, n groups of model images are selected, where the brightness value of the model image is in a range of 0-255. Correspondingly, the maximum brightness value of the model image is in the range of 0-255, and the average brightness value of the model image is in the range of 0-255.

Optionally, the maximum brightness values of the selected n groups of model images are uniformly distributed in the interval of 0-255. Specifically, if 11 groups of modeling images are selected, the maximum brightness values Lmax2 in each group of model images are 1, 25, 51, 76, 102, 127, 153, 178, 204, 229 and 255 respectively.

At step S4032, a Lavg2 set is generated by calculating the Lavg2 of each model image in any group of model images, where the Lavg2 is the average brightness value in the model image.

For example, Lmax2=25. When Lmax2=25, the Lavg2 of the corresponding model image is any value of 25, 24, 23, 22, 21, 20, 19, 18, 17, 16, 15, 13, 14, 12, 11, 10, 9, 8, 7, 6, 5, 4, 3, 2, 1 and 0.

The Lavg2 set is formed by Lavg2*s* of all model images in the group of Lmax2=25.

At step S4033, a y set is calculated according to the group of Lmax2=25 and the Lavg2 set, where the y is the brightness compensation factor.

For the group of Lmax2=25, one y is calculated according to one Lmax2=25 and one Lavg2, and one y set is obtained according to a plurality of groups of Lmax2=25 and a plurality of Lavg2*s*.

At step S4034, a y=f(Lavg2, Lmax2) relationship curve is established according to the group of Lmax2=25, the Lavg2 set and the y set.

Figure 16:
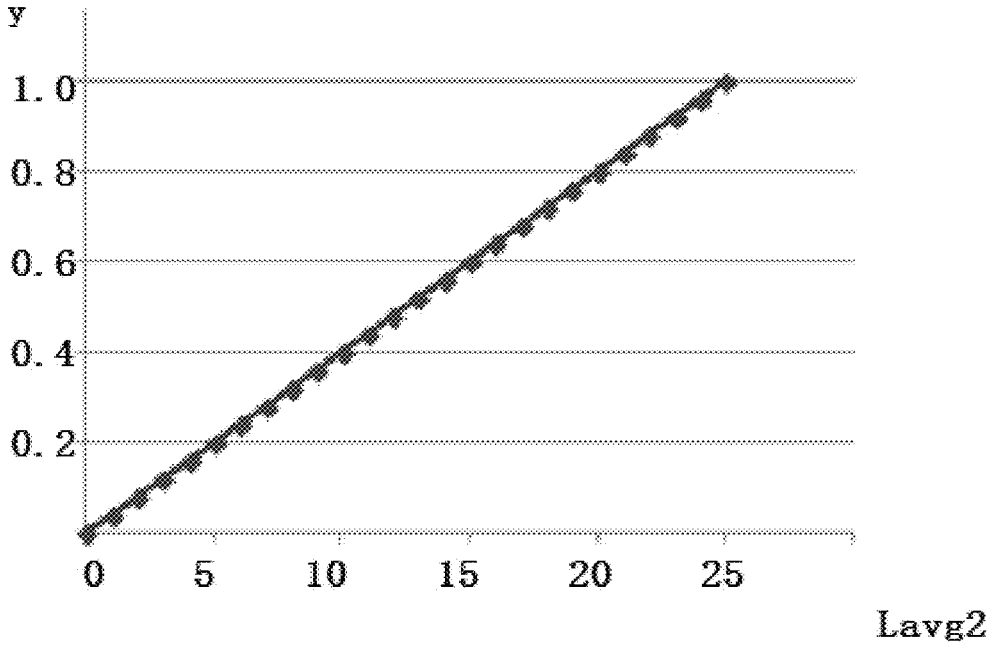
FIG. 16 is a schematic diagram illustrating a Lmax2=25 relationship curve according to an embodiment of the present disclosure.

For the group of Lmax2=25, the y=f(Lavg2, Lmax2) relationship curve is as shown in FIG. 16.

At step S4035, n relationship curves are constructed as the brightness compensation factor model.

To increase the contrast of the displayed image, in the embodiments of the present disclosure, the contrast of the display image is determined, which is generated based on the pixel brightness value of the displayed image, and the brightness compensation factor of the whole displayed image is determined according to the contrast. Generally, an image with a strong contrast requires to be further increased as much as possible. Therefore, the low greyscale of the displayed image is appropriately decreased, the high greyscale is appropriately increased. Original characteristics are maintained for a scenario with a small contrast as much as possible.

In the specific implementation process, an embodiment of the present disclosure further provides a method of calculating an average brightness value of each model image within each group. Specifically, a first brightness value set is generated by counting brightness values of different pixels of the model image; a second brightness value set is generated by traversing the first brightness value set and deleting the brightness value smaller than a preset brightness value; an average brightness value of the second brightness value set, that is, the average brightness value of the model image, is calculated.

For example, the preset brightness value is 10, and the pixels with the brightness value being less than 10 are deleted in the process of calculating the average brightness value of the displayed image. For example, the brightness values of three pixels of 10 pixels are less than 10. In this case, the method of calculating the average brightness value is to determine the average brightness value of the model image by summing up the brightness values of the remaining 7 pixels and dividing the sum by 10.

Figure 17:
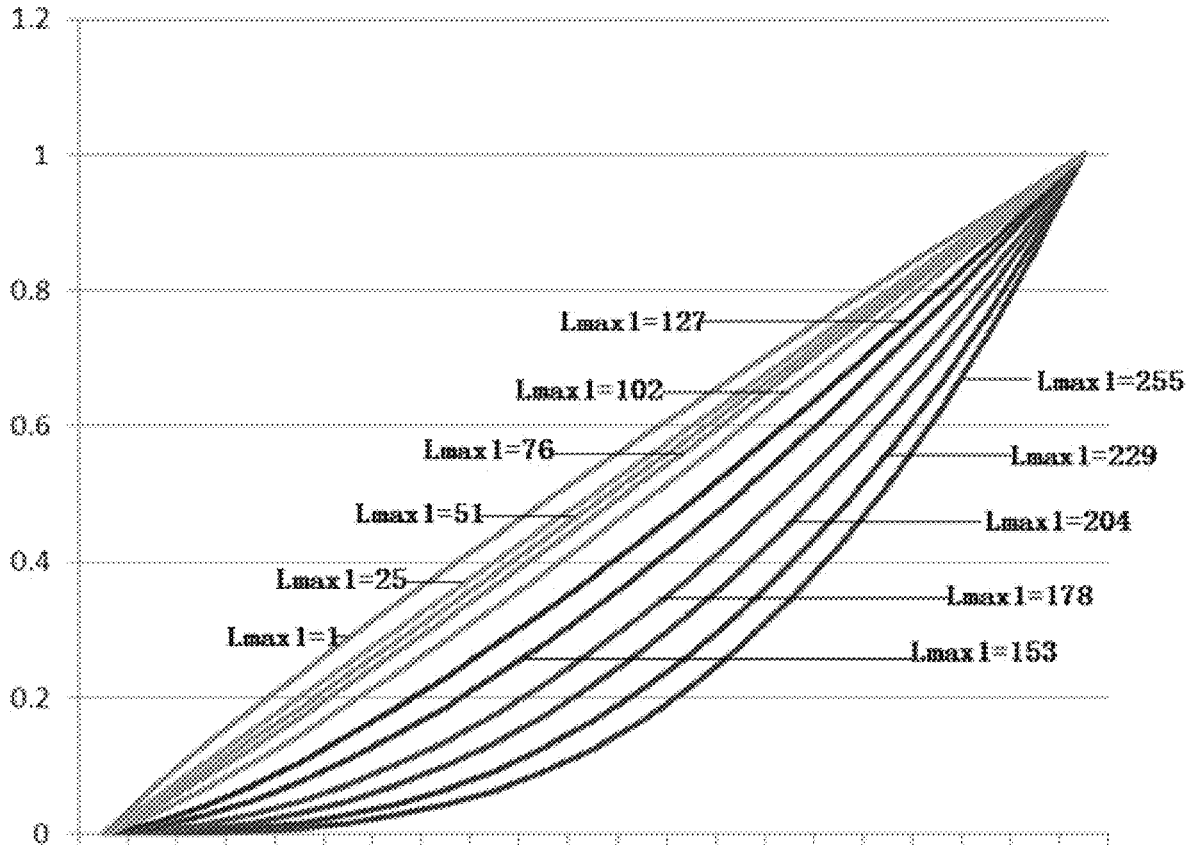
FIG. 17 is a schematic diagram illustrating a brightness compensation factor model according to an embodiment of the present disclosure.

Specifically, the finally-constructed 11 y=f(Lavg2, Lmax2=n) relationship curves are referred to FIG. 17, where a numerical value corresponding to the y-axis is the brightness compensation factor, a numerical value corresponding to the x-axis is Lavg2, and the above 11 relationship curves form the brightness compensation factor model.

The step of calculating the brightness compensation factor by placing the Lmax1 and Lavg1 into the brightness compensation factor model includes steps S4036-S4037.

At step S4036, for the brightness compensation factor model, if a Lmax1=Lmax2 relationship curve exists, the brightness compensation factor is obtained according to a corresponding relationship between the Lavg1*s* and the brightness compensation factors.

Figure 18:
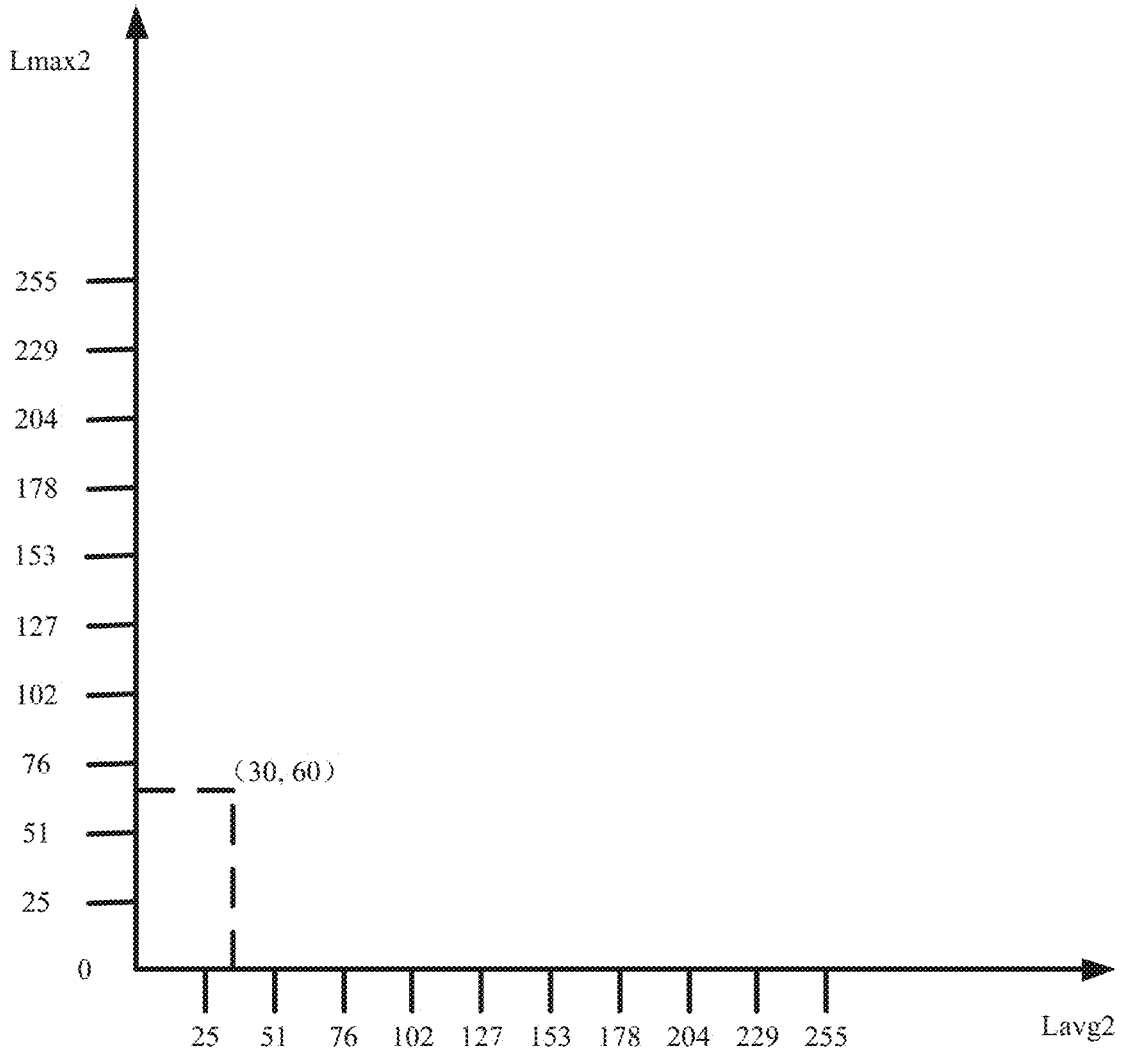
FIG. 18 is a schematic diagram illustrating an entry according to an embodiment of the present disclosure.

For example, when Lmax1=25 and Lavg1=13 in the displayed image, one relationship curve Lmax1=Lmax2 exists in the brightness compensation factor model shown in FIG. 18. In the relationship curve of Lmax2=25, the obtained brightness compensation factor corresponding to Lavg2=13 is the brightness compensation factor of the displayed image.

At step S4037, if the Lmax1=Lmax2 relationship curve does not exist in the brightness compensation factor model, the brightness compensation factor is calculated through the following several steps.

At step S40371, calibration points index0, index1, index2 and index3 of (Lmax1, Lavg1) and weight coefficients weight0, weight1, weight2 and weight3 corresponding to the calibration points are calculated.

At step S40372, brightness compensation factors date0, date1, date2 and date3 corresponding to index0, index1, index2 and index3 are determined by traversing the brightness compensation factor model.

At step S40373, the brightness compensation factor is obtained according to $y=(\Sigma_{i=0}^{3}\ \text{data}(i)\times\text{weight}(i))>>16$.

A process of calculating the calibration points and the weight coefficients is described below.

step_h;
index_x=(Lavg×step_h)>>14;
$m_0$=(step_h×Lavg)&0x3fff;
$m_1$=(1<<14)−$m_0$;
step_v;
index_y=(Lmax×step_v)>>14;
$n_0$=(step_v×Lmax)&0x3fff;
$n_1$=(1<<14)−$_0$;
index0=index_y×N+index_x;
index1=index_y×N+(index_x+1);
index2=(index_y+1)×N+index_x;
index3=(index_y+1)×N+(index_x+1);
weight0=($m_1$×$n_1$)>>12;
weight1=($m_0$×$n_1$)>>12;
weight2=($m_1$×$n_0$)>>12;
weight3=($m_0$×$n_0$)>>12.

In the above equations, step_h refers to a step length in an average value direction, step_v refers to a step length in a maximum value direction, and N is the number of relationship curves.

For example, for any displayed image, if Lavg1 is calculated as 30 and Lmax1 is calculated as 60, the average brightness value and the maximum brightness value of the displayed image form a point (30, 60).

If an item is established for the model image based on Lavg2 and Lmax2, for details, referring to FIG. 18, the item is established with Lavg2 as an abscissa and Lmax2 as an ordinate.

With further reference to FIG. 18, a process of determining the calibration points of (30, 60) includes: determining two Lavg2 values adjacent to 30 in the item as 25 and 51; and determining two Lmax2 values adjacent to 60 in the item as 51 and 76, thereby forming four calibration points index0, index1, index2 and index3.

The specific calculation process is as follows. Assuming that step_h=160;
Index_x=(30×160)>>14;
$m_0$=(160×30)&0x3fff;
$m_1$=(1<<14)−$m_0$;
step_v=160;
Index_y=(60×160)>>14;
$n_0$=(160×60)&0x3fff
$n_1$=(1<<14)−$n_0$
index0=index_y×11+index_x;
index1=index_y×11+(index_x+1);
index2=(index_y+1)×11+index_x;
index3=(index_y+1)×11+(index_x+1).

In the above equations, index0 is (25,51); index1 is (51,51); index2 is (25,76); index3 is (51, 76); the brightness compensation factors data0, data1, data2 and data3 corresponding to four calibration points (25,51), (51,51), (25,76) and (51,76) are determined in the brightness compensation factor model shown in FIG. 18. The weight coefficients corresponding to four calibration points respectively are:

weight0=($m_1$×$n_1$)>>12;
weight1=($m_0$×$n_1$)>>12;
weight2=($m_1$×$n_0$)>>12;
weight3=($m_0$×$n_0$)>>12;
brightness compensation factor=$(\Sigma_{i=0}^{3}\ \text{data_i}\times\text{weight_i})>>16$.

At step S404, the brightness drive signal corresponding to each frame of the displayed image is calculated according to the brightness compensation factor.

Alternatively, the steps of calculating the brightness drive signal corresponding to each frame of the displayed image according to the brightness compensation factor includes: obtaining the brightness drive signal corresponding to each frame of the displayed image by compensating the brightness corresponding to each frame of the displayed image according to the brightness compensation factor; and determining whether the brightness drive signal is greater than or equal to the maximum brightness value of the display apparatus.

It is assumed that M is the maximum brightness value of the display apparatus. If the display apparatus with an 8-bit channel includes 256 brightness and the maximum brightness value is 255, M is 255. If the display apparatus with a 10-bit channel includes 1024 brightness and the maximum brightness value is 1023, M is 1023.

The brightness drive signal is the maximum brightness value of the display apparatus, and the enhanced brightness value may exceed the range, and thus the value is required to be limited within a numeric range. Generally, for 8-bit data, if the brightness value obtained by multiplying the current brightness value by its respective y (the brightness compensation factor) is greater than 255, output brightness value is set to be 255.

If the brightness value is less than 255, the brightness drive signal is obtained by calculation according to the brightness compensation factor.

Figure 19:
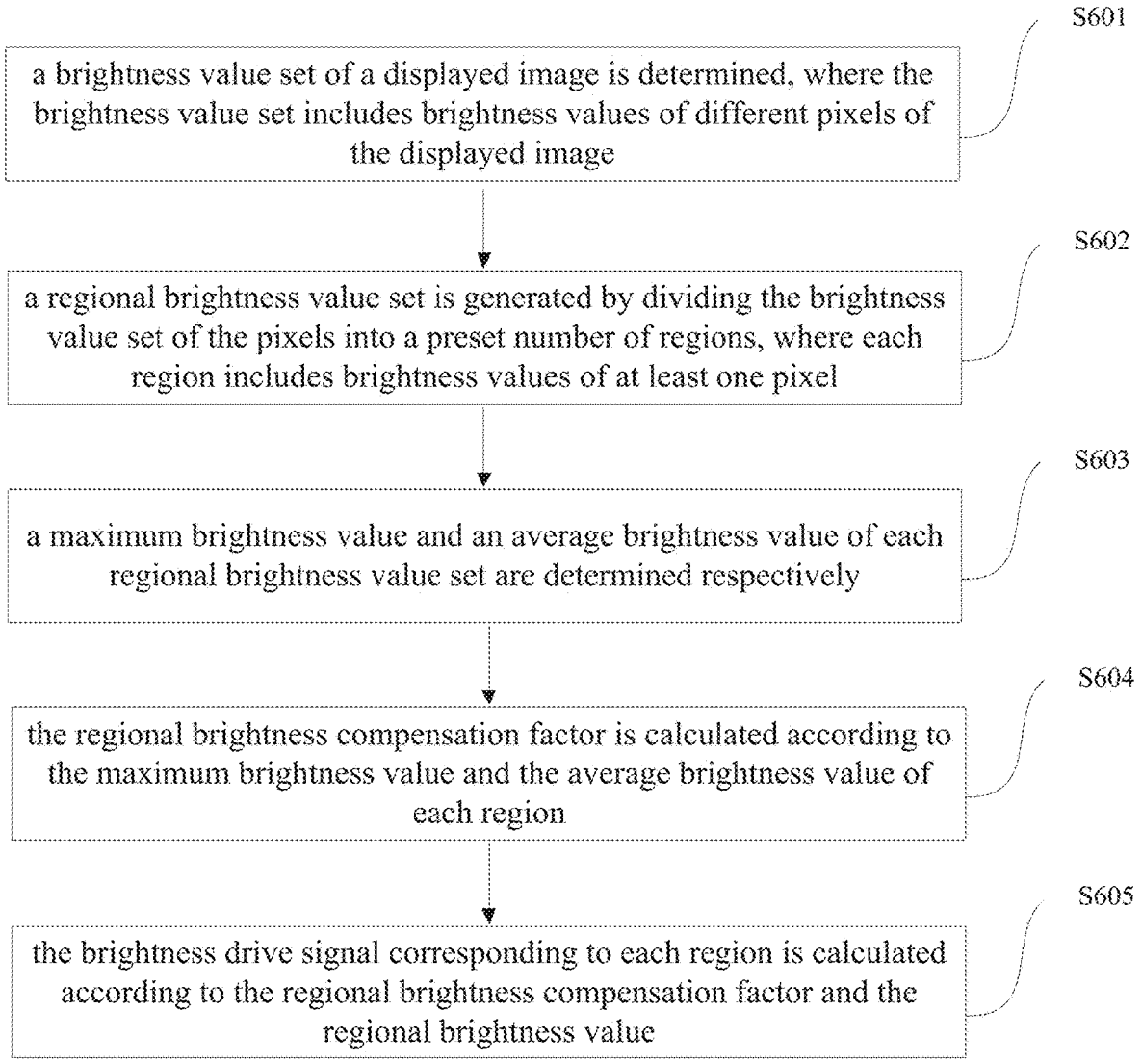
FIG. 19 is a flowchart illustrating a brightness driving method according to another embodiment of the present disclosure.

A brightness driving method is provided according to a second aspect of an embodiment of the present disclosure. The method is applied to the first panel of the dual-cell display apparatus. As shown in FIG. 19, the method includes steps S601-S605.

At step S601, a brightness value set of a displayed image is determined, where the brightness value set includes brightness values of different pixels of the displayed image.

At step S602, a regional brightness value set is generated by dividing the brightness value set of the pixels into a preset number of regions, where each region includes brightness values of at least one pixel.

Figure 20:
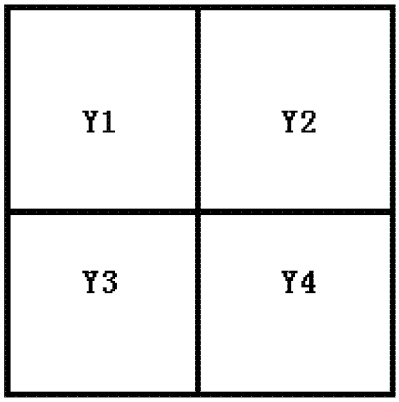
FIG. 20 is a schematic diagram illustrating a region of a displayed image according to an embodiment of the present disclosure.

For example, data of four points is down-sampled to data of one point. That is, pixels of 3840*2180 are divided into 1920*1080 small regions, and each region is as shown in FIG. 20.

At step S603, a maximum brightness value and an average brightness value of each regional brightness value set are determined respectively.

A method of calculating the regional brightness includes steps S6031-S6032.

At step S6031, Py-sum and Py-avg in the region are calculated, and Py-max and Py-mid in the region are determined. Py-sum is a sum of brightness of the pixels, Py-max is a maximum brightness value of the pixels, Py-avg is an average brightness value of the pixels, and Py-mid is a middle brightness value of the pixel.

A method of determining Py-max and Py-mid includes: determining Py-max by sorting Y1, Y2, Y3 and Y4 in an ascending or descending order. The middle value Py-mid of four pieces of brightness data is an average value of two pieces of brightness data in the middle, or any one of two pieces of brightness data in the middle.

At step S6032, $index_{brightness}$ is calculated according to $index_{brightness}$=(a×Py-max+b×Py-avg+c×Py-mid+512)>>10, where the $index_{brightness}$ is the regional brightness.

In the above equation, a, b and c are arbitrarily configured as long as a+b+c=1024 and a, b and c are all positive integers.

An embodiment of the present disclosure provides a shift valuing method to obtain Py-mid. The method avoids a process of sorting brightness of pixels, thereby reducing a data processing amount of a processor, and increases an overall process speed.

A specific operation process includes steps S60321-S60323.

At step S60321, Py-sum and Py-avg in the region are calculated, and Py-max and Py-min in the region are determined. Py-sum is the sum of brightness value of the pixels, Py-max is the maximum brightness value of the pixels, Py-avg is the average brightness value of the pixels, and Py-min is a minimum brightness value of the pixels.

At step S60322, Py-mid is calculated according to Py-mid=(Py-sum−Py-max−Py-min+1)>>1, where the Py-mid is a middle brightness value of the pixels.

At step S60323, $index_{brightness}$ is finally calculated according to $index_{brightness}$=(a×Py-max+b×Py-avg+c×Py-mid+512)>>10, where the $index_{brightness}$ is the regional brightness. a, b and c are arbitrarily configured as long as a+b+c=1024 and a, b and c are all positive integers.

The brightness of 3840*2180 pixels of the displayed image are combined and converted into 1920*1080 regional brightness. The 1920*1080 regional brightness form a regional brightness set, and accordingly, the brightness of the displayed image is the set of the 1920*1080 regional brightness.

In some embodiments of the present disclosure, 1920*1080 regional brightness is calibrated. Specifically, each value or some values of the regional brightness set is/are required to reach a target value (a measured value by an instrument), and the brightness data reaching the target value is filled in the regional brightness set. Each regional brightness is needed to be calibrated if the displayed image is required to be accurate.

Generally, some fixed sampling points are calibrated in an engineering implementation. After the sampling points are determined (equally spaced or unequally spaced), other brightness values are obtained by an interpolation method or a data fitting method.

A method of sampling specified curves is also used. For example, y=x, $y=x^{\gamma}$, γ=2.2, 2.3, 0.45. Determination is performed according to characteristics of the display panel and finally-desired presentation characteristics.

At step S604, the regional brightness compensation factor is calculated according to the maximum brightness value and the average brightness value of each region.

The brightness compensation factor according to some embodiments of the present disclosure may be an entire brightness compensation factor, or a regional brightness compensation factor. Accordingly, a corresponding compensation method is a method of enhancing an entire brightness or a method of enhancing a regional brightness.

(1) The brightness compensation factor of the method of enhancing the entire brightness is calculated as follows.

The calculated maximum brightness value Lmax1 of the displayed image is not a maximum value of all brightness values but a maximum value in terms of statistics. Generally, after the statistics processing is completed, a grayscale of which the number of pixels is not zero is obtained from grayscale 255 to grayscale 0, and the number of pixels contained in each grayscale is required to exceed a particular threshold (for example, 0.1% of the total number). If the number of pixels of the grayscale does not satisfy the requirement, the number of pixels of the grayscale is accumulated to the number of pixels of the next grayscale, until the number of pixels of the grayscale satisfying the condition is obtained. The grayscale is the maximum brightness value of the displayed image. For the calculation of the average brightness value Lavg1 of the displayed image, if the brightness values of the pixels of one displayed image are all accumulated and then divided by the number of pixels, a data bit width of the accumulated sum will generally overflow. Especially when the data bit widths are 10 bits and 12 bits, for convenience of calculation, the average brightness value of each row is firstly calculated, and then the average brightness values of n rows are calculated, and then averaging is performed for average brightness values of the n rows and finally the average brightness value of the entire displayed image is obtained.

The brightness compensation factor is calculated by placing Lmax1 and Lavg1 into the brightness compensation factor model. The construction manner of the brightness compensation factor model is similar to the construction manner of the brightness compensation factor model in the above embodiments. Therefore, a reference may be made to the above embodiments.

The data of the regional brightness $index_{brightness}$ is enhanced respectively. The enhanced brightness data may exceed the range and shall be limited within the data range. Generally, for the 8-bit data, if the data obtained by multiplying the brightness data by its respective y (the brightness compensation factor) is greater than 255, the output brightness data is set to 255.

(2) The brightness compensation factor of the method of enhancing the regional brightness is calculated as follows: the regional brightness compensation factor within each region is calculated respectively.

In some embodiments of the present disclosure, 3840*2180 pixels of the displayed image are converted into 1920*1080 regions. To improve an adjustment accuracy, the brightness compensation factor corresponding to each region is calculated respectively in the embodiments of the present disclosure.

Specifically, an average brightness value Lavg3 of each region and a maximum brightness value Lmax3 of the region are firstly calculated; the regional brightness compensation factor is calculated by placing Lmax3 and Lavg3 into the brightness compensation factor model.

At step S605, the brightness drive signal corresponding to each region is calculated according to the regional brightness compensation factor and the regional brightness value.

The regional brightness is enhanced, and a specific method of calculating the brightness drive signal is performed by multiplying each regional brightness by the brightness compensation factor.

The brightness compensation factor according to some embodiments of the present disclosure may be an entire brightness compensation factor, or a regional brightness compensation factor. Accordingly, the corresponding compensation method is a method of enhancing an entire brightness or a method of enhancing a regional brightness.

Where, the step of the calculating the brightness drive signal corresponding to each region according to the regional brightness compensation factor and the regional brightness includes: obtaining the brightness drive signal corresponding to each region by compensating the regional brightness corresponding to each region according to the regional brightness compensation factor; and determining whether the brightness drive signal is greater than or equal to the maximum brightness value of the display apparatus. If the brightness drive signal is greater than or equal to the maximum brightness value of the display apparatus, the brightness drive signal is the maximum brightness value of the display apparatus; if the brightness drive signal is not greater than or equal to the maximum brightness value of the display apparatus, the brightness drive signal is obtained by calculation according to the regional brightness compensation factor and the regional brightness.

The enhanced brightness data may exceed the range, and thus it is needed to be limited within the numeric range. Generally, for the 8-bit data, if the data obtained by multiplying the brightness data by its respective y is greater than 255, the output brightness data is set to 255.

After considering the above description and practicing the above disclosure herein, any person skilled in the art may easily conceive of other embodiments of the disclosures. The above disclosure aims to cover any variant, use or adaptive change of the disclosure, which fall within the general principles of the disclosure and includes common general knowledge or conventional technical means not disclosed by the disclosure in the technical field. The description and the embodiments are only for illustration, and the scope and sprits of the disclosure are indicated by the appended claims.

It should be understood that the disclosure is not limited to the precise structure described above and shown in the drawings, and various modifications and changes can be made without departing from its protection scope. The protection scope of the disclosure is limited only by the appended claims.

The invention claimed is:

1. A method of enhancing contrast for a dual-cell display apparatus, comprising:

receiving, by the dual-cell display apparatus comprising a memory storing instructions and a processor in communication with the memory, an RGB value of a second pixel of a displayed image;

determining, by the dual-cell display apparatus, a brightness value of a first pixel according to the RGB value of the second pixel, wherein the second pixel is a pixel on a second panel of the dual-cell display apparatus, the first pixel is a pixel on a first panel of the dual-cell display apparatus, and the first panel is arranged between a light emitting source and the second panel;

determining, by the dual-cell display apparatus, a local brightness adjustment factor and a global brightness adjustment factor by performing statistics processing for local region brightness values and global image brightness values according to brightness values of first pixels on the first panel; and calculating, by the dual-cell display apparatus, a brightness drive signal corresponding to the first pixel, according to the brightness values of the first pixels on the first panel, the local brightness adjustment factor and the global brightness adjustment factor, wherein the brightness drive signal is configured to adjust a transmittance of a corresponding pixel of the first panel, and the global brightness adjustment factor is configured to adjust an output brightness value of a corresponding pixel of the first panel.

2. The method according to claim 1, wherein the calculating the brightness drive signal corresponding to the first pixel, according to the brightness values of the first pixels on the first panel, the local brightness adjustment factor and the global brightness adjustment factor comprises:

generating, by the dual-cell display apparatus, a local brightness adjustment value by performing stretch adjustment for the brightness value of the first pixel according to the local brightness adjustment factor;

generating, by the dual-cell display apparatus, a global brightness adjustment value by performing stretch adjustment for the brightness value of the first pixel according to the global brightness adjustment factor; and calculating, by the dual-cell display apparatus, the brightness drive signal corresponding to the first pixel according to the local brightness adjustment value and the global brightness adjustment value.

3. The method according to claim 2, wherein:

the global brightness adjustment factor comprises a global brightness up-adjustment factor and a global brightness down-adjustment factor; and the generating the global brightness adjustment value by performing stretch adjustment for the brightness value of the first pixel according to the global brightness adjustment factor comprises:

calculating, by the dual-cell display apparatus, an average brightness value of the displayed image according to the brightness values of the first pixels on the first panel, for one of a plurality of first pixels, in response to the brightness value of the first pixel being less than the average brightness value of the displayed image, generating, by the dual-cell display apparatus, a global brightness adjustment value by adjusting down the brightness value of the first pixel according to the global brightness down-adjustment factor, and in response to the brightness value of the first pixel being greater than the average brightness value of the displayed image, generating, by the dual-cell display apparatus, a global brightness adjustment value by adjusting up the brightness value of the first pixel according to the global brightness up-adjustment factor.

4. The method according to claim 2, wherein:

the local brightness adjustment factor comprises a local brightness up-adjustment factor and a local brightness down-adjustment factor; and the generating the local brightness adjustment value by performing stretch adjustment for the brightness value of the first pixel according to the local brightness adjustment factor comprises:

for any one of first pixels, constituting, by the dual-cell display apparatus, a local region of m*n pixel block where the first pixel is a center pixel, wherein brightness values of the local region comprises brightness values of the m*n pixels, wherein m is an integer greater than 0, and n is an integer greater than 0, calculating, by the dual-cell display apparatus, an average brightness value of the local region according to the brightness values of the local region, in response to the brightness value of the first pixel being less than the average brightness value of the local region, generating, by the dual-cell display apparatus, local brightness adjustment value by adjusting down the brightness value of the first pixel according to the local brightness down-adjustment factor, and in response to the brightness value of the first pixel being greater than the average brightness value of the local region, generating, by the dual-cell display apparatus, a local brightness adjustment value by adjusting up the brightness value of the first pixel according to the local brightness up-adjustment factor.

5. The method according to claim 4, wherein the calculating the brightness drive signal corresponding to the first pixel, according to the local brightness adjustment value and the global brightness adjustment value comprises:

calculating, by the dual-cell display apparatus, a local brightness weight coefficient according to the local region brightness value corresponding to the first pixel;

calculating, by the dual-cell display apparatus, a local brightness output value according to the local brightness adjustment value and the local brightness weight coefficient;

calculating, by the dual-cell display apparatus, a global brightness output value according to the global brightness adjustment value and a global brightness weight coefficient, wherein a sum of the local brightness weight coefficient and the global brightness weight coefficient is 1; and calculating, by the dual-cell display apparatus, the brightness drive signal corresponding to the first pixel according to the local brightness output value and the global brightness output value.

6. The method according to claim 5, wherein the calculating the local brightness weight coefficient comprises:

selecting, by the dual-cell display apparatus, N local model regions, wherein a local model region comprises:

a model brightness value of a first model pixel, brightness values of neighbor pixels of the first model pixel, and a local model brightness weight coefficient corresponding to the first model pixel; wherein N is an integer greater than 0;

calculating, by the dual-cell display apparatus, a model brightness complexity of the first model pixel according to the model brightness value and the brightness values of the neighbor pixels;

constructing, by the dual-cell display apparatus, a first local brightness weight coefficient curve according to the model brightness complexity and the local model brightness weight coefficient;

for one of a plurality of first pixels, calculating, by the dual-cell display apparatus, a complexity of the first pixel according to the local region brightness value corresponding to the first pixel; and calculating, by the dual-cell display apparatus, the local brightness weight coefficient corresponding to the first model pixel according to the complexity of the first pixel and the first local brightness weight coefficient curve.

7. The method according to claim 5, wherein the calculating the local brightness weight coefficient comprises:

selecting, by the dual-cell display apparatus, N local model regions, wherein a local model region comprises:

brightness values of the local model region, and a local model brightness weight coefficient corresponding to a second model pixel, wherein the brightness values of the local model region comprises a model brightness value of the second model pixel and brightness values of neighbor pixels of the second model pixel; wherein N is an integer greater than 0;

generating, by the dual-cell display apparatus, a first model frequency set by counting appearance frequencies of each brightness value in local model region;

generating, by the dual-cell display apparatus, a second model frequency set by searching through the first model frequency set and deleting a portion of first model frequency smaller than a preset frequency;

counting, by the dual-cell display apparatus, a model number of brightness values contained in the second model frequency set, and constructing a second local brightness weight coefficient curve according to the model number of brightness values contained in the second model frequency and the local model brightness weight coefficient;

for one of a plurality of first pixel, counting, by the dual-cell display apparatus, a number of brightness values with a frequency greater than the preset frequency in the brightness values of the local region corresponding to the first pixel; and calculating, by the dual-cell display apparatus, the local brightness weight coefficient corresponding to the first pixel according to the number and the second local brightness weight coefficient curve.

8. The method according to claim 5, wherein the calculating the local brightness weight coefficient comprises:

selecting, by the dual-cell display apparatus, N local model regions, wherein a local model region comprises:

a model brightness value of a third model pixel, brightness values of neighbor pixels of the third model pixel, and a local model brightness weight coefficient corresponding to the third model pixel; wherein N is an integer greater than 0;

calculating, by the dual-cell display apparatus, a model brightness characteristic of the third model pixel according to the model brightness value of the third model pixel and the brightness values of the neighbor pixels;

constructing, by the dual-cell display apparatus, a third local brightness weight coefficient curve according to the model brightness characteristic and the local model brightness weight coefficient;

for one of a plurality of first pixels, calculating, by the dual-cell display apparatus, a brightness characteristic of the first pixel; and calculating, by the dual-cell display apparatus, the local brightness weight coefficient corresponding to the first pixel according to the brightness characteristic of the first pixel and the third local brightness weight coefficient curve.

9. The method according to claim 1, further comprising:

determining, by the dual-cell display apparatus, a local color adjustment factor by counting RGB values of a local region according to RGB values of a plurality of second pixels;

determining, by the dual-cell display apparatus, a global color adjustment factor according to RGB values of the second pixels on the entire second panel, and statistic values for global image brightness values of the second panel; and calculating, by the dual-cell display apparatus, a color drive signal corresponding to the second pixel according to the RGB value of the second pixel, the local color adjustment factor and the global color adjustment factor, wherein the color drive signal is configured to adjust the RGB value of the second pixel corresponding to the second panel.

10. A dual-cell display apparatus, comprising:

a memory storing instructions;

a processor in communication with the memory;

a first panel in connection with the processor and configured to receive a brightness drive signal and adjust a transmittance corresponding to a first pixel according to the brightness drive signal; and a second panel in connection with the processor and configured to receive a color drive signal and adjust an RGB value corresponding to a second pixel according to the color drive signal;

wherein, when the processor executes the instructions, the processor is configured to:

receive an RGB value of the second pixel of a displayed image;

determine a brightness value of the first pixel according to the RGB value of the second pixel, wherein the second pixel is a pixel on a second panel of the dual-cell display apparatus, the first pixel is a pixel on a first panel of the dual-cell display apparatus, and the first panel is arranged between a light emitting source and the second panel;

determine a local brightness adjustment factor and a global brightness adjustment factor by performing statistics processing for local region brightness values and global image brightness values according to brightness values of first pixels on the first panel; and calculate a brightness drive signal corresponding to the first pixel, according to the brightness values of the first pixels on the first panel, the local brightness adjustment factor and the global brightness adjustment factor, wherein the brightness drive signal is configured to adjust a transmittance of a corresponding pixel of the first panel, and the global brightness adjustment factor is configured to adjust an output brightness value of a corresponding pixel of the first panel.

11. The dual-cell display apparatus according to claim 10, wherein the processor is further configured to calculate the brightness drive signal corresponding to the first pixel, according to the brightness values of the first pixels, the local brightness adjustment factor and the global brightness adjustment factor by:

generating a local brightness adjustment value by performing stretch adjustment for the brightness value of the first pixel according to the local brightness adjustment factor;

generating a global brightness adjustment value by performing stretch adjustment for the brightness value of the first pixel according to the global brightness adjustment factor; and calculating the brightness drive signal corresponding to the first pixel according to the local brightness adjustment value and the global brightness adjustment value.

12. The dual-cell display apparatus according to claim 11, wherein:

the global brightness adjustment factor comprises a global brightness up-adjustment factor and a global brightness down-adjustment factor; and the processor is further configured to generate the global brightness adjustment value by performing stretch adjustment for the brightness value of the first pixel according to the global brightness adjustment factor by:

calculating an average brightness value of the displayed image according to the brightness values of the first pixels on the first panel, for one of a plurality of first pixels, in response to the brightness value of the first pixel being less than the average brightness value of the displayed image, generating a global brightness adjustment value by adjusting down the brightness value of the first pixel according to the global brightness down-adjustment factor, and in response to the brightness value of the first pixel being greater than the average brightness value of the displayed image, generating a global brightness adjustment value by adjusting up the brightness value of the first pixel according to the global brightness up-adjustment factor.

13. The dual-cell display apparatus according to claim 11, wherein:

the local brightness adjustment factor comprises a local brightness up-adjustment factor and a local brightness down-adjustment factor; and the processor is further configured to generate the local brightness adjustment value by performing stretch adjustment for the brightness value of the first pixel according to the local brightness adjustment factor by:

for any one of first pixels, constituting a local region of m*n pixel block where the first pixel is a center pixel, wherein brightness values of the local region comprises brightness values of the m*n pixels, wherein m is an integer greater than 0, and n is an integer greater than 0, calculating an average brightness value of the local region according to the brightness values of the local region, in response to the brightness value of the first pixel being less than the average brightness value of the local region, generating a local brightness adjustment value by adjusting down the brightness value of the first pixel according to the local brightness down-adjustment factor, and in response to the brightness value of the first pixel being greater than the average brightness value of the local region, generating a local brightness adjustment value by adjusting up the brightness value of the first pixel according to the local brightness up-adjustment factor.

14. The dual-cell display apparatus according to claim 13, wherein the processor is further configured to calculate the brightness drive signal corresponding to the first pixel according to the local brightness adjustment value and the global brightness adjustment value by:

calculating a local brightness weight coefficient according to the local region brightness value corresponding to the first pixel;

calculating a local brightness output value according to the local brightness adjustment value and the local brightness weight coefficient;

calculating a global brightness output value according to the global brightness adjustment value and a global brightness weight coefficient; wherein a sum of the local brightness weight coefficient and the global brightness weight coefficient is 1; and calculating the brightness drive signal corresponding to the first pixel according to the local brightness output value and the global brightness output value.

15. The dual-cell display apparatus according to claim 14, wherein the processor is further configured to calculate the local brightness weight coefficient by:

selecting N local model regions, wherein a local model region comprises:

a model brightness value of a first model pixel, brightness values of neighbor pixels of the first model pixel, and a local model brightness weight coefficient corresponding to the first model pixel; wherein N is an integer greater than 0;

calculating a model brightness complexity of the first model pixel according to the model brightness value and the brightness values of the neighbor pixels;

constructing a first local brightness weight coefficient curve according to the model brightness complexity and the local model brightness weight coefficient;

for one of a plurality of first pixels, calculating a complexity of the first pixel according to the local region brightness value corresponding to the first pixel; and calculating the local brightness weight coefficient corresponding to the first model pixel according to the complexity of the first pixel and the first local brightness weight coefficient curve.

16. The dual-cell display apparatus according to claim 14, wherein the processor is further configured to calculate the local brightness weight coefficient by:

selecting N local model regions, wherein a local model region comprises:

brightness values of the local model region, and a local model brightness weight coefficient corresponding to a second model pixel, wherein the brightness values of the local model region comprises: a model brightness value of the second model pixel and brightness values of neighbor pixels of the second model pixel; wherein N is an integer greater than 0;

generating a first model frequency set by counting appearance frequencies of each brightness value in local model region;

generating a second model frequency set by searching through the first model frequency set and deleting a portion of first model frequency smaller than a preset frequency;

counting a model number of brightness values contained in the second model frequency set, and constructing a second local brightness weight coefficient curve according to the model number of brightness values contained in the second model frequency and the local model brightness weight coefficient;

for one of a plurality of first pixel, counting a number of brightness values with a frequency greater than the preset frequency in the brightness values of the local region corresponding to the first pixel; and calculating the local brightness weight coefficient corresponding to the first pixel according to the number and the second local brightness weight coefficient curve.

17. The dual-cell display apparatus according to claim 14, wherein the processor is further configured to calculate local brightness weight coefficient by:

selecting N local model regions, wherein a local model region comprises:

a model brightness value of a third model pixel, brightness values of neighbor pixels of the third model pixel, and a local model brightness weight coefficient corresponding to the third model pixel; wherein N is an integer greater than 0;

calculating a model brightness characteristic of the third model pixel according to the model brightness value of the third model pixel and the brightness values of the neighbor pixels;

constructing a third local brightness weight coefficient curve according to the model brightness characteristic and the local model brightness weight coefficient;

for one of a plurality of first pixels, calculating a brightness characteristic of the first pixel; and calculating the local brightness weight coefficient corresponding to the first pixel according to the brightness characteristic of the first pixel and the third local brightness weight coefficient curve.

18. The dual-cell display apparatus according to claim 10, wherein, when the processor executes the instructions, the processor is further configured to:

determine a local color adjustment factor by counting RGB values of a local region according to RGB values of a plurality of second pixels;

determine a global color adjustment factor according to RGB values of the second pixels on the entire second panel, and statistic values for global image brightness values of the second panel; and calculate a color drive signal corresponding to the second pixel according to the RGB value of the second pixel, the local color adjustment factor and the global color adjustment factor, wherein the color drive signal is configured to adjust the RGB value of the second pixel corresponding to the second panel.

* * * * *